US008955934B2

(12) United States Patent
Ishimoto et al.

(10) Patent No.: US 8,955,934 B2
(45) **Date of Patent: *Feb. 17, 2015**

(54) FLUID EJECTING APPARATUS AND FLUID EJECTING METHOD

(75) Inventors: Bunji Ishimoto, Nagano-ken (JP); Yumiko Takeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 633 days.

This patent is subject to a terminal disclaimer.

(21) Appl. No.: 12/833,713

(22) Filed: Jul. 9, 2010

(65) Prior Publication Data

US 2011/0025737 A1 Feb. 3, 2011

(30) Foreign Application Priority Data

Jul. 28, 2009 (JP) ..... 2009-175735

(51) Int. Cl.
*B41J 29/38* (2006.01)
*B41J 2/21* (2006.01)

(52) U.S. Cl.
CPC ..... *B41J 2/2114* (2013.01); *B41J 2/2117* (2013.01)
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 6,511,144 | B2 | 1/2003 | Otsuki | |
| 6,719,403 | B2 | 4/2004 | Kanda et al. | |
| 7,267,425 | B2 | 9/2007 | Kawase et al. | |
| 7,407,277 | B2 | 8/2008 | Yoneyama | |
| 7,798,602 | B2 | 9/2010 | Kobayashi et al. | |
| 8,201,908 | B2 | 6/2012 | Tanoue et al. | |
| 8,292,391 | B2 | 10/2012 | Ishimoto et al. | |
| 2002/0154182 | A1 | 10/2002 | Takahashi et al. | |
| 2003/0142168 | A1 | 7/2003 | Suzuki et al. | |
| 2004/0233249 | A1* | 11/2004 | Vanhooydonck | 347/41 |
| 2005/0162451 | A1 | 7/2005 | Suzuki et al. | |
| 2008/0152413 | A1 | 6/2008 | Yoshida et al. | |
| 2009/0160895 | A1 | 6/2009 | Matsuzawa | |
| 2011/0025744 | A1* | 2/2011 | Ishimoto et al. | 347/14 |
| 2011/0037800 | A1* | 2/2011 | Tanoue et al. | 347/12 |

FOREIGN PATENT DOCUMENTS

| | | | |
|---|---|---|---|
| JP | 2000-025210 | A | 1/2000 |
| JP | 2002-038063 | A | 2/2002 |
| JP | 2002-166578 | | 6/2002 |
| JP | 2002-307672 | A | 10/2002 |
| JP | 2003-285427 | A | 10/2003 |
| JP | 2003-326779 | A | 11/2003 |
| JP | 2007-223139 | A | 9/2007 |
| JP | 2008-221645 | | 9/2008 |
| WO | WO2005/105452 | A1 | 11/2005 |

* cited by examiner

*Primary Examiner* — Laura Martin

(57) ABSTRACT

A fluid ejecting apparatus includes first and second rows of nozzles for ejecting first and second fluids respectively, a mechanism that transports the medium in the row direction, a mechanism that moves the nozzle rows in a direction intersecting the direction of the rows, and a controller that repeats an image formation operation while the medium is transported and the rows of nozzles moved. After forming a first image using the first row of nozzles, a second image is formed on the first image using the second row of nozzles in another image formation operation. For normal image formation, the second nozzles are set further downstream in the nozzle row direction than the first nozzles, and for image formation on a lower end portion of the medium, the second nozzles are set further upstream in the nozzle row direction than they are during normal image formation.

6 Claims, 13 Drawing Sheets

FLUID EJECTING APPARATUS AND FLUID EJECTING METHOD

CROSS-REFERENCE TO RELATED APPLICATION(S)

Japanese Patent application No. 2009-175735 is incorporated by reference herein in its entirety.

BACKGROUND

1. Field of Invention

The present invention relates to a fluid ejecting apparatus and a fluid ejecting method.

2. Description of Related Art

As one of the fluid ejecting apparatuses, an ink jet printer having nozzle rows in which nozzles that eject ink (fluid) onto a medium are arranged in a row in a given direction is given. Among the ink jet printers, there is known a printer in which an operation for ejecting ink from nozzles while moving nozzle rows in a moving direction intersecting a given direction and an operation for transporting a medium with respect to the nozzle rows in a transport direction which is the given direction are repeated.

There is proposed a printing method in which in such a printer, for example, in the case of forming dot rows at intervals narrower than the nozzle arrangement intervals (nozzle pitch), the number of nozzles used or a transport distance of the medium is changed at the time of the printing of the lower end portion of the medium.

JP-A-2008-221645 is an example of the related art.

Incidentally, in order to increase a color-producing property of an image, for example, there is a case where after the printing of a background image by white ink, a color image is printed on the background image by color ink. In this case, for example, the nozzles for printing the background image are fixed to the nozzles of a half on the upstream side in a transport direction of a white nozzle row, and the nozzles for printing the color image are fixed to the nozzles of a half on the downstream side in the transport direction of a color ink nozzle row. Then, at the last of the printing, a color image is printed on the already printed background image by the color ink nozzles on the downstream side in the transport direction. Therefore, a print ending position is on the downstream side in the transport direction with respect to a head, so that a position control range of the medium becomes longer.

SUMMARY OF INVENTION

An advantage of some aspects of the invention is that it makes a position control range of a medium as short as possible.

According to a first aspect of the invention, there is provided a fluid ejecting apparatus including: (1) a first nozzle row in which first nozzles that eject first fluid are arranged in a row in a given direction; (2) a second nozzle row in which second nozzles that eject second fluid are arranged in a row in the given direction; (3) a movement mechanism which moves the first nozzle row and the second nozzle row with respect to a medium in a moving direction intersecting the given direction; (4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image by the first fluid in a certain image formation operation, a second image is formed on the first image by the second fluid in another image formation operation, at the time of normal image formation, the second nozzles for forming the second image are set to be nozzles which are located further on the downstream side in the given direction than the first nozzles for forming the first image, and at the time of image formation of a lower end portion of the medium, the second nozzles for forming the second image are set to be nozzles which are located further on the upstream side in the given direction than the second nozzles for forming the second image at the time of the normal image formation.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF THE PREFERRED EMBODIMENTS

Figure 1:
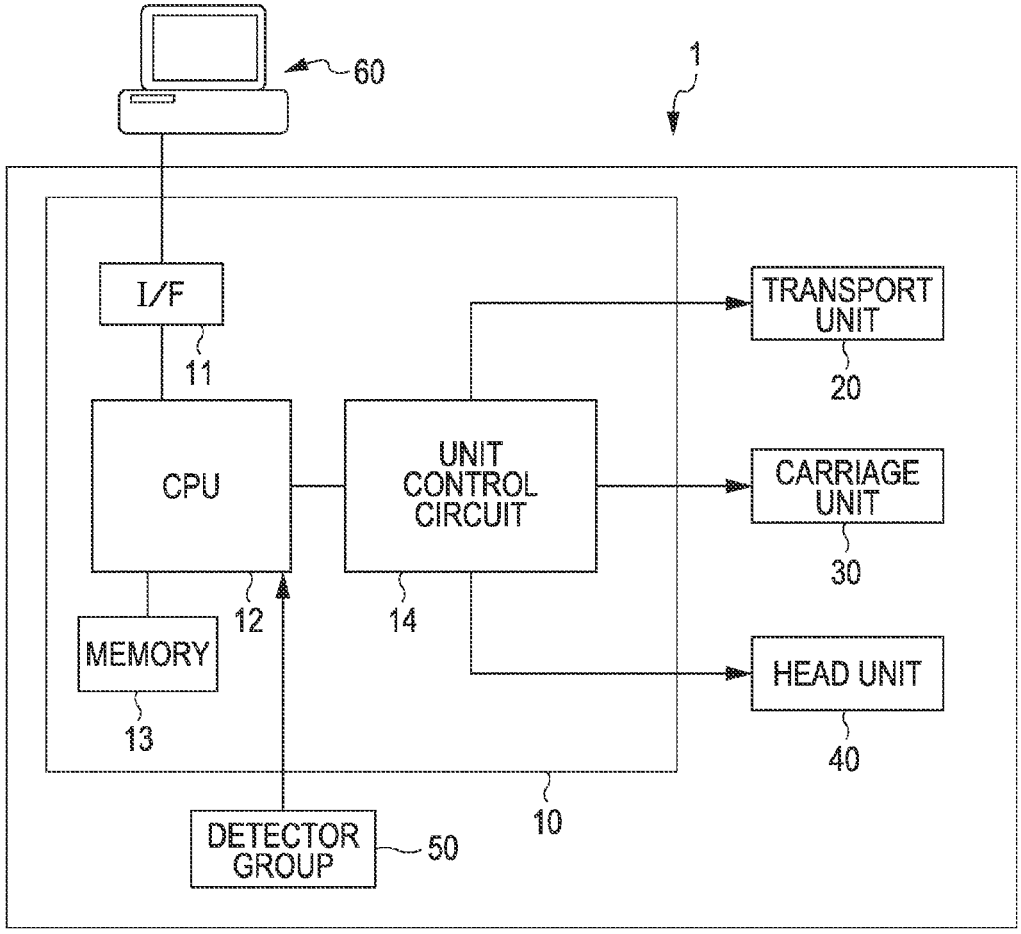
FIG. 1 is a block diagram showing the entire configuration of a printer.

At least the following aspects will become apparent from the description of this specification and the accompanying drawings.

That is, according to a first aspect of the invention, there is provided a fluid ejecting apparatus including: (1) a first nozzle row in which first nozzles that eject first fluid are arranged in a row in a given direction; (2) a second nozzle row in which second nozzles that eject second fluid are arranged in a row in the given direction; (3) a movement mechanism which moves the first nozzle row and the second nozzle row with respect to a medium in a moving direction intersecting the given direction; (4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image by the first fluid in a certain image formation operation, a second image is formed on the first image by the second fluid in another image formation operation, at the time of normal image formation, the second nozzles for forming the second image are set to be nozzles which are located further on the downstream side in the given direction than the first nozzles for forming the first image, and at the time of image formation of a lower end portion of the medium, the second nozzles for forming the second image are set to be nozzles which are located further on the upstream side in the given direction than the second nozzles for forming the second image at the time of the normal image formation.

According to such a fluid ejecting apparatus, a position control range of the medium can be shortened, so that a margin amount of, for example, the lower end portion of the medium can become smaller.

In such a fluid ejecting apparatus, the total amount of an amount at which at the time of the image formation of the lower end portion of the medium, with respect to the second nozzles for forming the second image at the time of a certain image formation operation, the second nozzles for forming the second image at the time of the subsequent image formation operation are shifted to the upstream side in the given direction and an amount at which the medium is transported in the given direction by the transport operation at the time of the image formation of the lower end portion of the medium is the same as an amount at which the medium is transported in the given direction by the transport operation at the time of the normal image formation.

According to such a fluid ejecting apparatus, it is possible to make a fluid ejecting method (dot formation method) at the time of the image formation of the lower end portion of the medium be close to a fluid ejecting method at the time of the normal image formation, so that, for example, it is possible to make the time after the formation of the first image and until the formation of the second image be the same as that at the time of the image formation of the lower end portion of the medium and the time of the normal image formation.

In such a fluid ejecting apparatus, the amount at which at the time of the image formation of the lower end portion of the medium, with respect to the second nozzles for forming the second image at the time of a certain image formation operation, the second nozzles for forming the second image at the time of the subsequent image formation operation are shifted to the upstream side in the given direction is constant.

According to such a fluid ejecting apparatus, since the whole of the second nozzle row can be averagely used, so that at the time of the image formation of the lower end portion of the medium, a transport amount of the medium can become constant, a transport operation can be stabilized.

In such a fluid ejecting apparatus, the time after the formation of the first image at a certain region on the medium at the time of the normal image formation and until the formation of the second image is the same as the time after the formation of the first image at a certain region on the medium at the time of the image formation of the lower end portion of the medium and until the formation of the second image.

According to such a fluid ejecting apparatus, for example, density unevenness of an image can be suppressed.

In such a fluid ejecting apparatus, at the time of image formation of an upper end portion of the medium, the control section sets the first nozzles for forming the first image to be nozzles which are located further on the downstream side in the given direction than the first nozzles for forming the first image at the time of the normal image formation.

According to such a fluid ejecting apparatus, the position control range of the medium can be shortened, so that a margin amount of, for example, the upper end portion of the medium can become smaller.

Also, according to a second aspect of the invention, there is a fluid ejecting method in which by a fluid ejecting apparatus where an image formation operation for ejecting fluid from first nozzles and second nozzles while moving a first nozzle row, in which the first nozzles that eject first fluid are arranged in a row in a given direction, and a second nozzle row, in which the second nozzles that eject second fluid are arranged in a row in the given direction, in a moving direction intersecting the given direction and a transport operation for transporting a medium with respect to the first nozzle row and the second nozzle row in the given direction are repeated, after the formation of a first image by the first fluid in a certain image formation operation, a second image is formed on the first image by the second fluid in another image formation operation, the method including: ejecting fluid by setting the second nozzles for forming the second image to be nozzles which are located further on the downstream side in the given direction than the first nozzles for forming the first image, at the time of normal image formation; and ejecting fluid by setting the second nozzles for forming the second image to be nozzles which are located further on the upstream side in the given direction than the second nozzles for forming the second image at the time of the normal image formation, at the time of image formation of a lower end portion of the medium.

According to such a fluid ejecting method, the position control range of the medium can be shortened, so that a margin amount of, for example, the lower end portion of the medium can become smaller.

Concerning Printing System

Hereinafter, embodiments will be explained by setting a fluid ejecting apparatus to be an ink jet printer and taking a serial type printer (hereinafter referred to as a printer 1) among the ink jet printers as an example.

Figure 2A:
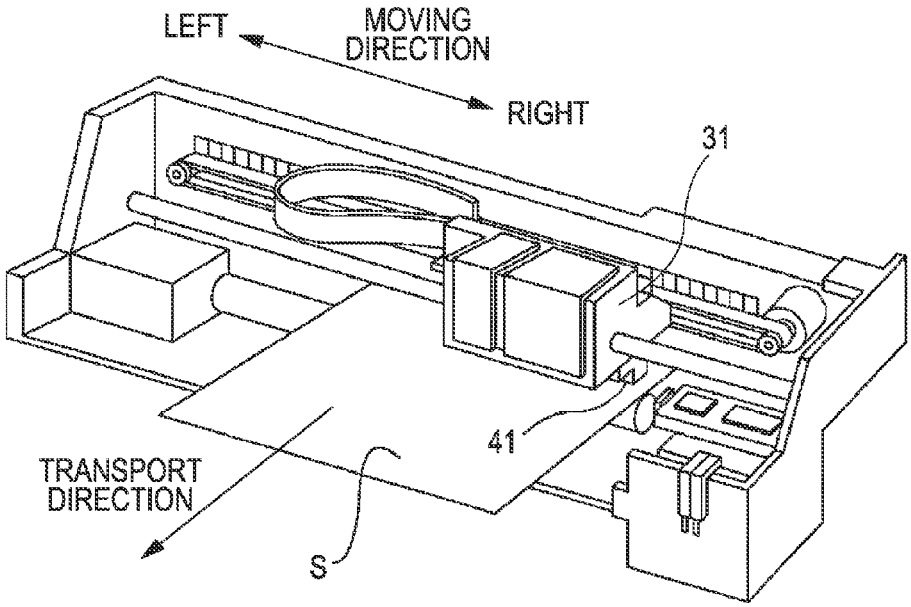
FIG. 2A is a perspective view of the printer and FIG. 2B is a cross-sectional view of the printer.
Figure 2B:
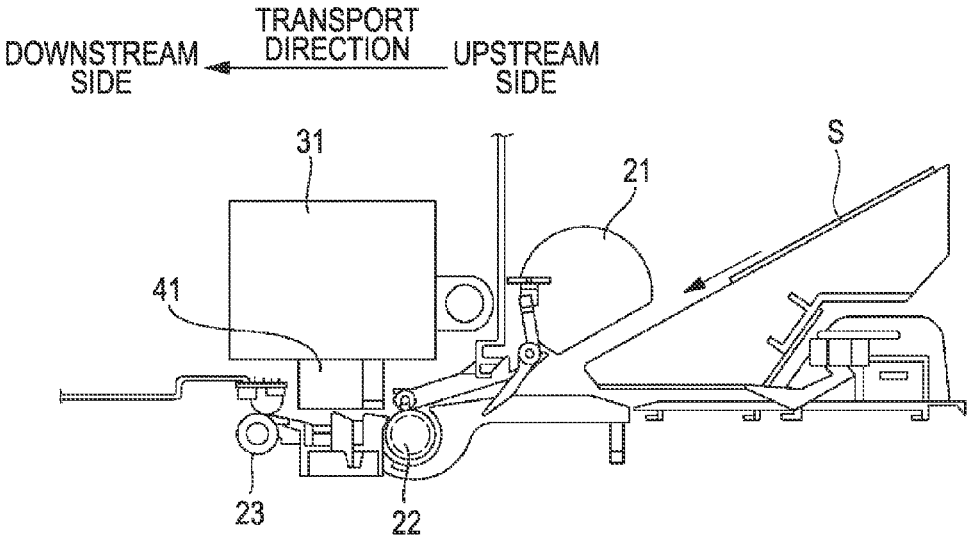

FIG. 1 is a block diagram showing the entire configuration of the printer 1. FIG. 2A is a perspective view of the printer 1 and FIG. 2B is a cross-sectional view of the printer 1. The printer 1 which has received printing data from a computer 60 that is an external device controls each unit (a transport unit 20, a carriage unit 30, and a head unit 40) by a controller 10, thereby forming an image on a medium S (such as paper or film). Also, a detector group 50 monitors the conditions in the printer 1, and on the basis of the detection results thereof, the controller 10 controls each unit.

The controller 10 (a control section) is a control unit for carrying out control of the printer 1. An interface section 11 is for carrying out the transmitting and the receiving of data between the computer 60, which is an external device, and the printer 1. A CPU 12 is an arithmetic processing device for carrying out control of the whole of the printer 1. A memory 13 is for securing an area which stores a program of the CPU 12, a work area, or the like. The CPU 12 controls each unit by a unit control circuit 14 in accordance with the program stored in the memory 13.

The transport unit 20 (a transport mechanism) is to send the medium S to a printable position and transport the medium S at a given transport amount in a transport direction (a given direction) at the time of the printing, and has a paper feed roller 21, a transport roller 22, and a paper discharge roller 23. The paper feed roller 21 is rotated, thereby sending the medium S to be printed up to the transport roller 22. The controller 10 rotates the transport roller 22, thereby positioning the medium S at a print start position.

The carriage unit 30 (a movement mechanism) is for moving a head 41 in a direction (hereinafter referred to as a moving direction) intersecting the transport direction and has a carriage 31.

The head unit 40 is for ejecting ink onto the medium S and has the head 41. The head 41 is moved in the moving direction by the carriage 31. A plurality of nozzles which is an ink ejecting section is provided at the lower face of the head 41, and an ink chamber (not shown) in which ink is contained is provided at each nozzle.

Figure 3:
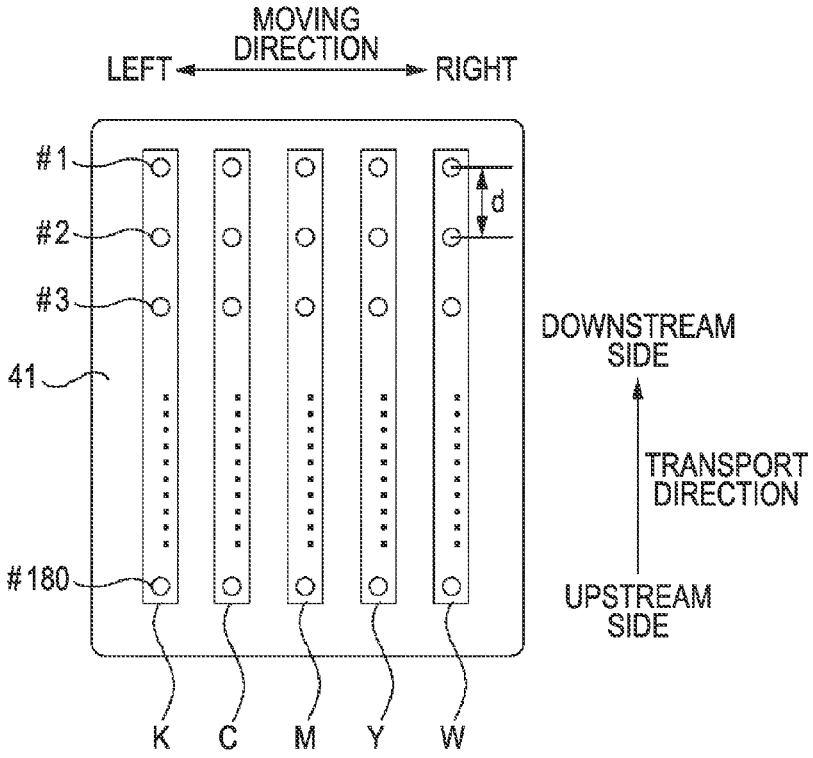
FIG. 3 is a diagram showing a nozzle arrangement of the lower face of a head.

FIG. 3 is a diagram showing a nozzle arrangement of the lower face of the head 41. Five nozzle rows each having 180 nozzles arranged in a row at given intervals (at a nozzle pitch d) in the transport direction are formed at the lower face of the head 41. As shown in the drawing, a black nozzle row K which ejects black ink, a cyan nozzle row C which ejects cyan ink, a magenta nozzle row M which ejects magenta ink, a yellow nozzle row Y which ejects yellow ink, and a white nozzle row W which ejects white ink are arranged in order in the moving direction. In addition, 180 nozzles of each nozzle row are numbered (#1 to #180) in ascending order from the nozzle on the downstream side in the transport direction.

In the printer 1, a dot formation processing for forming a dot on the medium by intermittently ejecting an ink droplet from the head 41 which moves along the moving direction and a transport processing (corresponding to a transport operation) for transporting the medium in the transport direction with respect to the head 41 are repeated. By doing so, it is possible to form a dot at a position on the medium, which is different from a position of the dot formed by the prior dot formation processing, so that a two-dimensional image can be printed on the medium. In addition, an operation (corresponding to single dot-formation processing or an image formation operation) in which the head 41 moves once in the moving direction while ejecting ink droplets is called a "pass".

Concerning Print Mode

In the printer 1 of this embodiment, a "4-color print mode" and a "5-color print mode" can be selected. The "4-color print mode" is a mode in which a color image is directly printed on the medium by the black nozzle row K, the cyan nozzle row C, the magenta nozzle row M, and the yellow nozzle row Y. That is, in the 4-color print mode, ink droplets are ejected from the nozzle rows YMCK of four colors (hereinafter collectively referred to as a "color nozzle row Co") toward the medium. In addition, black-and-white printing is carried out by the 4-color print mode.

On the other hand, the "5-color print mode" is a mode in which a background image (corresponding to a first image) is first printed on the medium by white ink (corresponding to first fluid) and a color image (corresponding to a second image) is then printed on the background image by ink of 4 colors (YMCK; corresponds to second fluid). That is, in the 5-color print mode, ink droplets are ejected from the white nozzle row W (corresponding to a first nozzle row) toward the medium, and ink droplets are ejected from the color nozzle row Co (corresponding to a second nozzle row) toward the background image. By doing so, an image which is excellent in a color-producing property can be printed. In addition, the nozzle which ejects white ink corresponds to a first nozzle, and the nozzle which ejects each ink of 4 colors corresponds to a second nozzle.

Specifically, in the 5-color print mode, a background image is printed at a certain region on the medium by the white nozzle row W in the prior pass, and a color image is printed on the background image printed at a certain region on the medium, by the color nozzle row Co in the posterior pass. In this manner, with respect to the same region on the medium, by making the pass (prior pass) which prints a background image and the pass (posterior pass) which prints a color image be differently performed, it is possible to print a color image after the drying of a background image. As a result, bleeding of an image can be prevented.

Concerning Transport Unit 20

Figure 4:
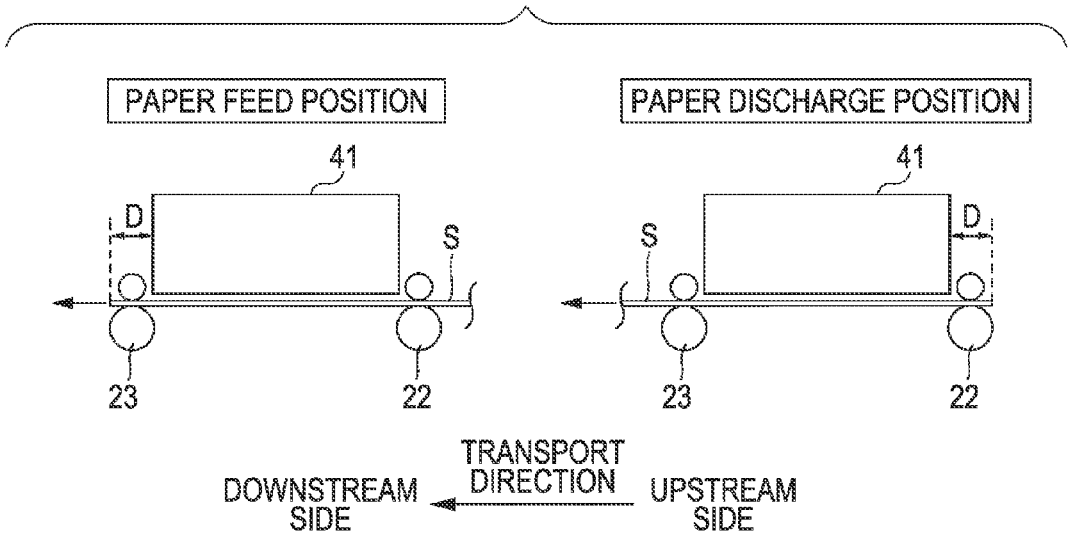
FIG. 4 is a diagram showing a paper feed position and a paper discharge position by a transport unit.

FIG. 4 is a diagram showing a paper feed position and a paper discharge position of the medium S by the transport unit 20 of the printer 1. In the printer 1 of this embodiment, in a state where the medium S has been nipped by both of the transport roller 22 and the paper discharge roller 23, the printing is performed. By doing so, the medium S can be stably transported. In addition, in the following explanation, among two end portions along the moving direction of the medium S, the end portion on the upstream side in the transport direction is called an "upper end portion" and the end portion on the downstream side in the transport direction is called a "lower end portion".

The left drawing of FIG. 4 is a drawing showing a position (a paper feed position of the medium S) of the medium S with respect to the head 41 at the time of the start of the printing. Here, a state where the upper end portion of the medium S is located on the downstream side in the transport direction a length D farther than the end portion on the downstream side in the transport direction of the head 41 is referred to as a "paper feed position (a print start position)". At the shown paper feed position, the printing can be started in a state where the medium S is nipped by the transport roller 22 and the paper discharge roller 23.

On the other hand, the right drawing of FIG. 4 is a drawing showing a position (a paper discharge position of the medium S) of the medium S with respect to the head 41 at the time of the ending of the printing. Here, a state where the lower end portion of the medium S is located on the upstream side in the transport direction a length D farther than the end portion on the upstream side in the transport direction of the head 41 is referred to as a "paper discharge position (a print ending position)". At the shown paper discharge position, the printing can be finished in a state where the medium S is nipped by the transport roller 22 and the paper discharge roller 23.

Concerning Band Printing

4-Color Print Mode

Figure 5:
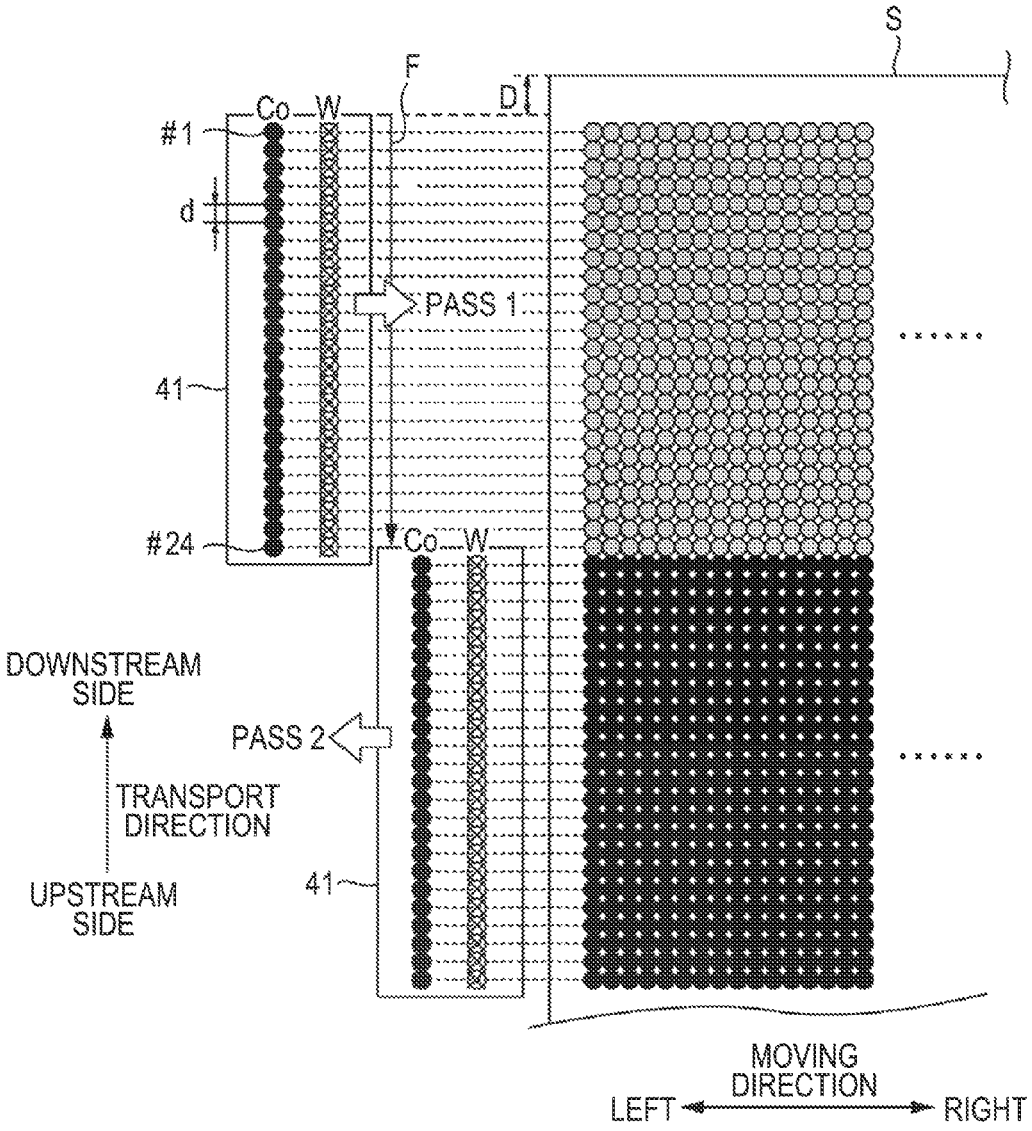
FIG. 5 is a diagram explaining band printing in a 4-color print mode.

FIG. 5 is a diagram explaining band printing in the 4-color print mode. For simplification of explanation, the nozzles of the head 41 are depicted with the number thereof reduced (#1 to #24). Also, the nozzle rows (YMCK) of 4 colors other than the white nozzle row W are collectively depicted as the "color nozzle row Co". In the actual printer 1, the medium S is transported in the transport direction with respect to the head 41. However, in the drawing, the head 41 is depicted to be moved in the transport direction with respect to the medium S.

As shown in FIG. 4, the medium S at the time of the start of the printing is located on the downstream side a length D farther than the end portion on the downstream side in the transport direction of the head 41. Therefore, also in FIG. 5, the medium S is depicted to be located on the downstream side a length D farther than the end portion on the downstream side in the transport direction of the head 41 of Pass 1.

As described above, in the 4-color print mode, a color image is directly printed on the medium S by the nozzle rows (YMCK=the color nozzle row Co) of 4 colors. Therefore, in the 4-color print mode, white ink is not ejected from the white nozzle row W. Also, in the 4-color print mode, all the nozzles belonging to the color nozzle row Co become nozzles usable in the printing (hereinafter referred to as ejection-able nozzles). However, the invention is not limited thereto, but even if it is the 4-color print mode, all the nozzles belonging to the color nozzle row Co need not be set to be the ejection-able nozzles. For example, similarly to the time of a 5-color print mode, which will be described later, the nozzles of a half of the color nozzle row Co may also be set to be the ejection-able nozzles.

Band printing is a printing method in which images (band images) each having a width which is formed by single movement (pass) in the moving direction of the head 41 are arranged in a row in the transport direction, whereby an image is formed. Here, since the number of entire nozzles belonging to the color nozzle row Co is set to be 24, one band image is constituted by 24 raster lines (dot rows along the moving direction). In addition, in FIG. 5, a band image which is formed by first Pass 1 is represented by gray dots, and a band image which is formed by subsequent Pass 2 is represented by black dots.

That is, in the band printing, an operation for forming a band image by ejecting ink droplets from the color nozzle row Co during the movement of the head 41 and an operation for transporting the medium S by the width F of the band image are alternately repeated. Therefore, in the band printing, between the raster lines formed in a certain pass, a raster line is not formed in another pass. That is, in the band printing, the distance between the raster lines corresponds to the nozzle pitch d.

5-Color Print Mode of Comparative Example

Figure 6A:
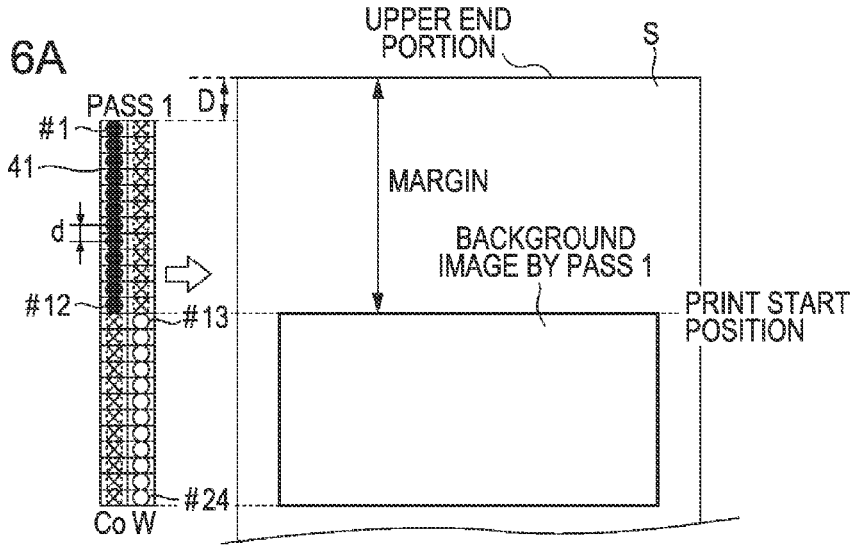
FIGS. 6A and 6B are diagrams showing an aspect in which the upper end portion of a medium is printed by the band printing in a 5-color print mode of a comparative example.
Figure 6B:
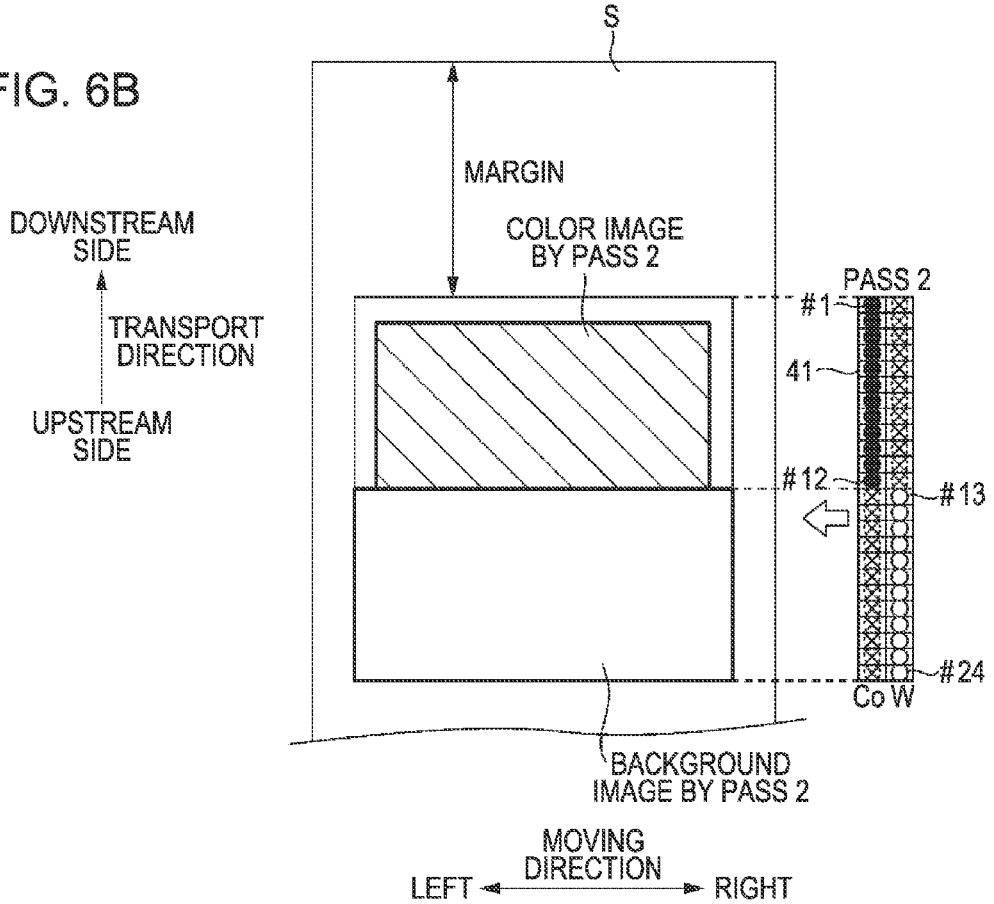
Figure 7A:
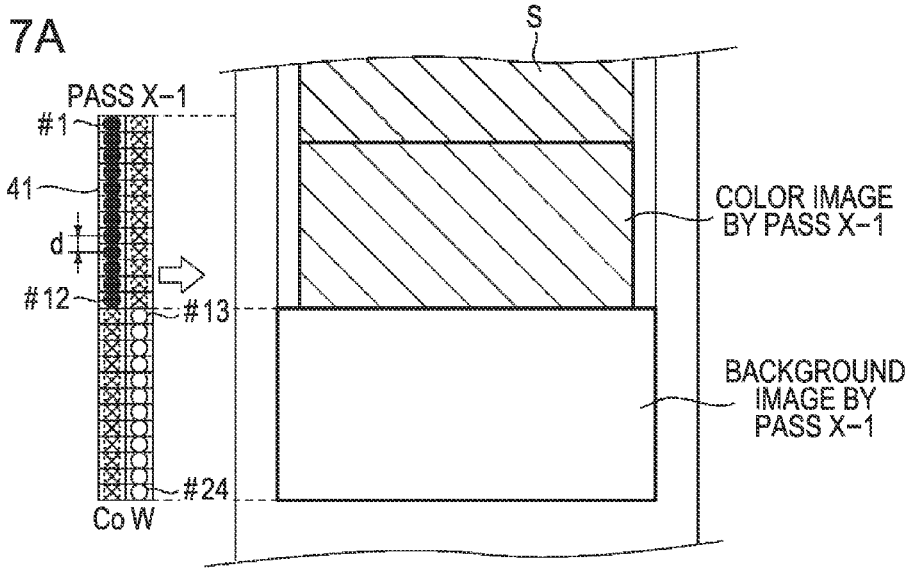
FIGS. 7A and 7B are diagrams showing an aspect in which the lower end portion of the medium is printed by the band printing in the 5-color print mode of the comparative example.
Figure 7B:
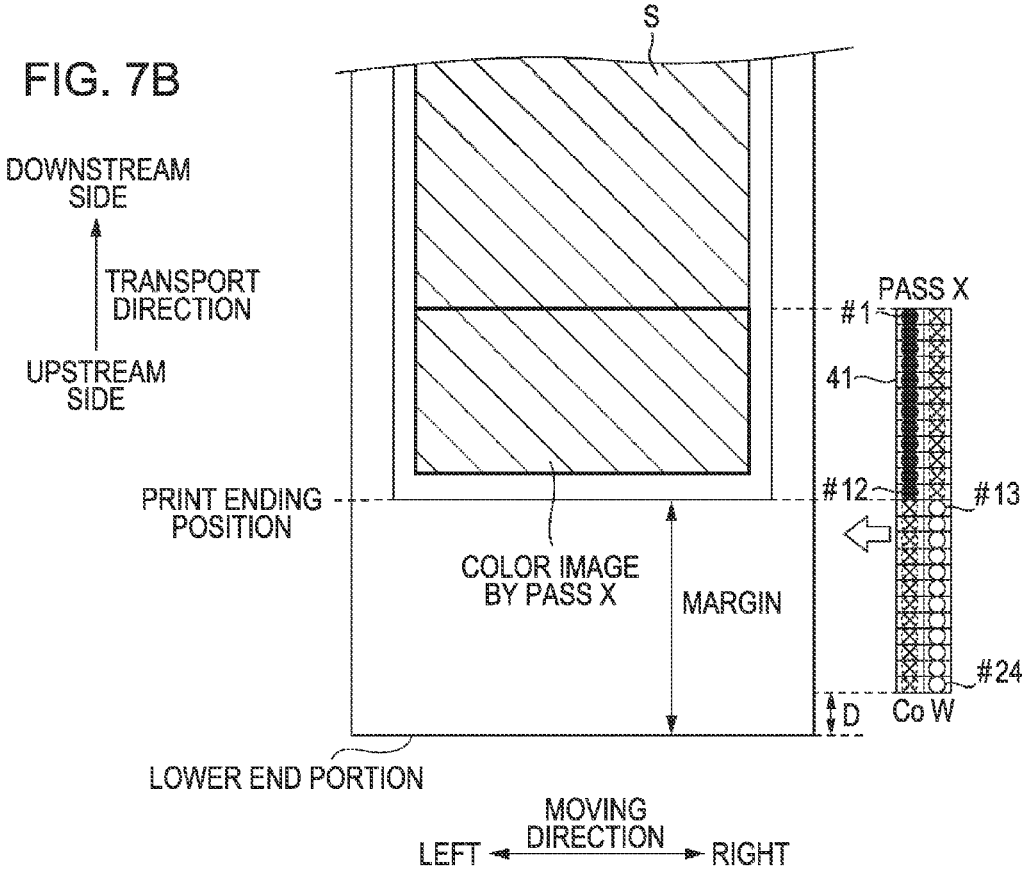

FIGS. 6A and 6B are diagrams showing an aspect in which the upper end portion of the medium S is printed by the band printing in a 5-color print mode of a comparative example, and FIGS. 7A and 7B are diagrams showing an aspect in which the lower end portion of the medium S is printed by the band printing in the 5-color print mode of the comparative example. In addition, the portion (a portion which is first printed) on the upstream side in the transport direction of the medium S is the upper end portion of the medium S, and the portion (a portion which is finally printed) on the downstream side in the transport direction of the medium S is the lower end portion of the medium S. Also, for simplification of explanation, the nozzles of each of the nozzle rows Co and W are depicted with the number thereof reduced (#1 to #24). In the drawings, each nozzle is depicted in a rectangular frame, and the length in the transport direction of one frame corresponds to the nozzle pitch d.

As described above, in the 5-color print mode, after the printing of a background image by the white nozzle row W, a color image is printed on the background image by the color nozzle row Co (=YMCK) in a different pass. Thus, in the 5-color print mode of the comparative example, the nozzles (#13 to #24) of a half on the upstream side in the transport direction of the white ink nozzle row W are set to be the nozzles for printing a background image. Then, the nozzles (#1 to #12) of a half on the downstream side in the transport direction of the color nozzle row Co (=YMCK) are set to be the nozzles for printing a color image. In addition, here, from the nozzles (#1 to #12) of a half on the downstream side in the transport direction of the white nozzle row W, white ink is not ejected, and from the nozzles (#13 to #24) of a half on the upstream side in the transport direction of the color nozzle row Co, ink is not ejected.

Next, a concrete printing method will be explained. First, as shown in FIG. 6A, at the time of the start of the printing (the paper feed position), a state is made where the upper end portion of the medium S is located on the downstream side in the transport direction a length D farther than the end portion on the downstream side in the transport direction of the head 41 (of Pass 1). Then, in Pass 1, a background image is printed by the nozzles #13 to #24 on the upstream side in the transport direction of the white nozzle row W. The background image (a thick line) which is formed by twelve nozzles (#13 to #24) of the white nozzle row W is composed of twelve raster lines. In addition, in Pass 1, from the color nozzle row Co, ink is not ejected.

Next, the medium S is transported by the width (twelve nozzle pitches=12d) of the background image printed in Pass 1. Then, in Pass 2, a background image (a thick line) is printed by the nozzles #13 to #24 on the upstream side in the transport direction of the white nozzle row W. As a result, the background image printed in Pass 1 and the background image printed in Pass 2 are arranged in a row in the transport direction. Also, in Pass 2, a color image (an oblique line portion) is printed by the nozzles #1 to #12 on the downstream side in the transport direction of the color nozzle row Co. As a result, on the background image formed in Pass 1, a color image is printed in Pass 2.

Thereafter, an operation for forming a background image by the nozzles #13 to #24 on the upstream side in the transport direction of the white nozzle row W and forming a color image on the background image formed in the prior pass, by the nozzles #1 to #12 on the downstream side in the transport direction of the color nozzle row Co and an operation for transporting the medium S in the transport direction by twelve nozzles (12d, 12 frames) are alternately repeated. By doing so, on the background image printed in the prior pass, a color image is printed in the subsequent pass, so that a printed matter with the color image printed on the background image can be completed.

That is, the nozzles (#13 to #24) which print a background image are set to be nozzles which are located further on the upstream side in the transport direction than the nozzles (#1 to #12) which print a color image. By doing so, with respect to a certain region on the medium S, it is possible to print a background image in the prior pass and print a color image on the background image in the posterior pass.

In such a printing method of the comparative example, as shown in FIG. 6A, the position of the raster line which is formed by the nozzle #13 of the central portion of the white nozzle row W in a state where the upper end portion of the medium S is located on the downstream side a length D farther than the end portion on the downstream side in the transport direction of the head 41 becomes the print start position. In other words, the summed length of a length D by which the upper end portion of the medium S protrudes with respect to the head 41 at the time of the start of the printing and a length for twelve nozzles (a length for the nozzles which do not print a background image) corresponds to a margin at the upper end portion of the medium S.

On the contrary, in the 4-color print mode shown in FIG. 5, the position of the raster line which is formed by the nozzle #1 on the most downstream side in a state where the upper end portion of the medium S is located on the downstream side a length D farther than the end portion on the downstream side in the transport direction of the head 41 becomes the print start position. Therefore, in the 5-color print mode of the comparative example, compared to the 4-color print mode shown in FIG. 5, a margin amount at the upper end portion of the medium S becomes larger. This is because in the 5-color print mode of the comparative example, the white ink nozzle row W, which first prints a background image on the medium, is fixed to the nozzles (#13 to #24) of a half on the upstream side in the transport direction. Therefore, the print start position is a position on the upstream side in the transport direction with respect to the head 41.

FIGS. 7A and 7B are diagrams showing an aspect in which the lower end portion of the medium S is printed. As shown in FIG. 7A, in Pass X−1 one before the last, a color image is printed on a background image by the nozzles (#1 to #12) of a half on the downstream side in the transport direction of the color nozzle row Co, and a background image is printed by the nozzles (#13 to #24) of a half on the upstream side in the transport direction of the white nozzle row W. Thereafter, the medium S is transported by a length (12d) for twelve nozzles.

Then, in the final Pass X (FIG. 7B), ink is ejected from the nozzles (#1 to #12) on the downstream side in the transport direction of the color nozzle row Co onto the background printed in the prior Pass X−1, and from the white nozzle row W, ink is not ejected. By doing so, a color image can be printed on all background images, so that the printing is finished.

In the printer 1 of this embodiment, in a state where the lower end portion of the medium S is located on the upstream side a length D farther than the end portion on the upstream side in the transport direction of the head 41 of the final Pass X, the printing is finished. Therefore, the position of the raster line which is formed by the nozzle #12 of the central portion of the color nozzle row Co in a state where the lower end portion of the medium S protrudes to the upstream side a length D farther than the end portion on the upstream side in the transport direction of the head 41 becomes the print ending position. In other words, a length summed up a length D by which the lower end portion of the medium S protrudes with respect to the head 41 at the time of the ending of the printing and a length for twelve nozzles (a length for the nozzles which do not print a color image) corresponds to a margin at the lower end portion of the medium S.

On the contrary, in the 4-color print mode (not shown), the position of the raster line which is formed by the nozzle #24 on the most upstream side in a state where the lower end portion of the medium S is located on the upstream side a length D farther than the end portion on the upstream side in the transport direction of the head 41 becomes the print ending position. Therefore, in the 5-color print mode of the comparative example, compared to the 4-color print mode, a margin amount at the lower end portion of the medium S becomes larger. This is because in the 5-color print mode of the comparative example, the nozzles for printing a color image are fixed to the nozzles (#1 to #12) of a half on the downstream side in the transport direction of the color nozzle row Co. Therefore, the print ending position is a position on the downstream side in the transport direction with respect to the head 41.

In this manner, in the 5-color print mode of the comparative example, the print start position is a position on the upstream side in the transport direction with respect to the head 41, and the print ending position is a position on the downstream side in the transport direction with respect to the head 41. Therefore, a range for controlling a position of the medium S (a length in the transport direction in which position control of the medium S is carried out) during the printing becomes longer.

Therefore, like the printer 1 which is used in this embodiment, in a case where the printing is performed in a state where the medium S is nipped by both the transport roller 22 and the paper discharge roller 23 (FIG. 4), at the time of the start of the printing, as shown in FIG. 6A, a margin amount at the upper end portion of the medium S becomes larger. On the other hand, at the time of the ending of the printing, as shown in FIG. 7B, a margin amount at the lower end portion of the medium S becomes larger. As a result, a size of an image which can be printed on the medium S is reduced or a size of the medium S must be large.

Figure 8A:
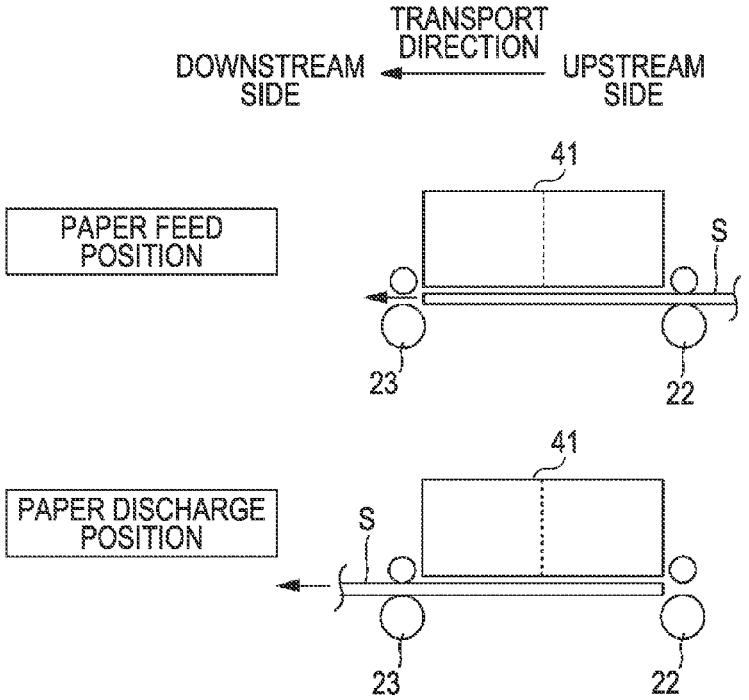
FIGS. 8A and 8B are diagrams showing a paper feed position and a paper discharge position of the medium in a printer having a different transport unit.
Figure 8B:
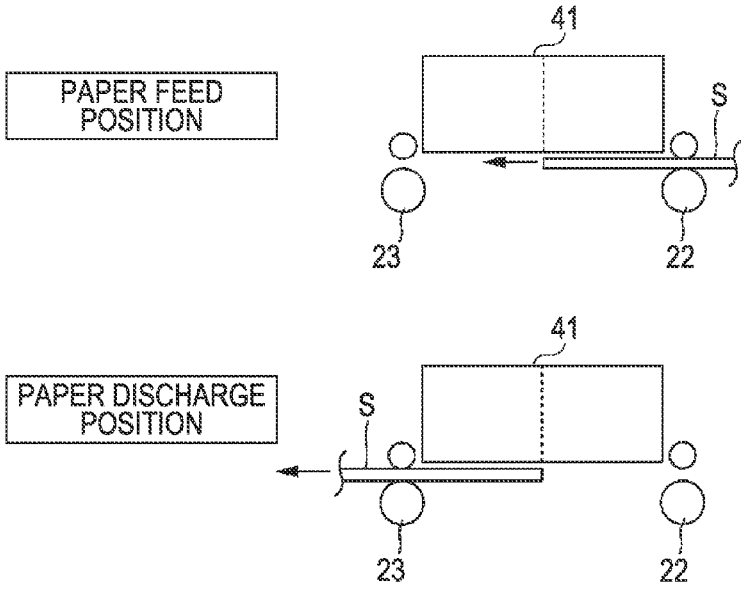

FIGS. 8A and 8B are diagrams showing the paper feed position and the paper discharge position of the medium S in another printer having a different transport unit 20. Besides a printer in which the printing is performed in a state where the medium S is nipped by both the transport roller 22 and the paper discharge roller 23, there is also a printer in which the printing can be performed in a state where the medium S is nipped only by the roller on one side. That is, there is also a printer in which the paper feed position (a head poking position) and the paper discharge position are variable.

In such a printer, for example, in a case where the 4-color print mode is carried out (the case of printing only a color image on the medium), the paper feed position and the paper discharge position of the medium S become the positions shown in FIG. 8A. In the 4-color print mode, since all the nozzles belonging to the color nozzle row Co are used, it is possible to make the upper end portion of the medium S be located on the downstream side in the transport direction with respect to the head 41 at the time of the start of the printing and to make the lower end portion of the medium S be located on the upstream side in the transport direction with respect to the head 41 at the time of the ending of the printing.

On the contrary, in the case of carrying out the 5-color print mode (the band printing) of the comparative example, the paper feed position and the paper discharge position of the medium S become the positions shown in FIG. 8B. In the 5-color print mode of the comparative example, as shown in FIG. 6A, since the nozzles of a half on the upstream side in the transport direction of the white nozzle row W are used, the upper end portion of the medium S is located on the upstream side in the transport direction with respect to the head 41 at the time of the start of the printing. On the other hand, at the time of the ending of the printing, as shown in FIG. 7B, since the nozzles of a half on the downstream side in the transport direction of the color nozzle row Co are used, the lower end portion of the medium S is located on the downstream side in the transport direction with respect to the head 41.

In the case of a printer in which the printing can be performed in a state where the medium S is nipped by one roller of the transport roller 22 and the paper discharge roller 23, also in the 5-color print mode of the comparative example, a margin amount of the medium S can become smaller. However, compared to a case (an example: the 4-color print mode) capable of feeding and discharging the medium S, as shown in FIG. 8A, in the case (the 5-color print mode of the comparative example) of feeding and discharging the medium S, as shown in FIG. 8B, the position control range of the medium S becomes longer. Then, a transport error easily occurs. For example, in the case of controlling the position in the transport direction of the medium S by a rotation amount (transport amount) by the transport roller 22 after the detection of the upper end portion of the medium S by a sensor provided at the upstream side in the transport direction, the longer a transport control range, the more easily the transport error occurs.

Also, as shown in FIG. 8B, in a case where the paper feed position is located on the upstream side in the transport direction with respect to the head 41, the protrusion amount of the medium S to the upstream side in the transport direction with respect to the head 41 becomes larger. Similarly, in a case where the paper discharge position is located on the downstream side in the transport direction with respect to the head 41, the protrusion amount of the medium S to the downstream side in the transport direction with respect to the head 41 becomes larger. Therefore, a size of the transport unit 20 becomes larger or jamming of the medium S is easily generated.

In this manner, in the 5-color print mode of the comparative example, the print start position is a position on the upstream side in the transport direction with respect to the head 41, and the print ending position is a position on the downstream side in the transport direction with respect to the head 41. That is, the position control range of the medium S becomes longer. As a result, the transport error easily occurs, a margin of the medium S becomes larger, or the protrusion amount of the medium S from the head 41 is larger, whereby a size of the transport unit 20 becomes larger.

Therefore, in this embodiment, an object is to make the position control range of the medium S as short as possible in the case (the 5-color print mode) of printing a color image on a background image. In other words, in this embodiment, an object is to make the print start position be on the downstream side in the transport direction as much as possible and make the print ending position be on the upstream side in the transport direction as much as possible.

5-Color Print Mode of this Embodiment

Figure 9:
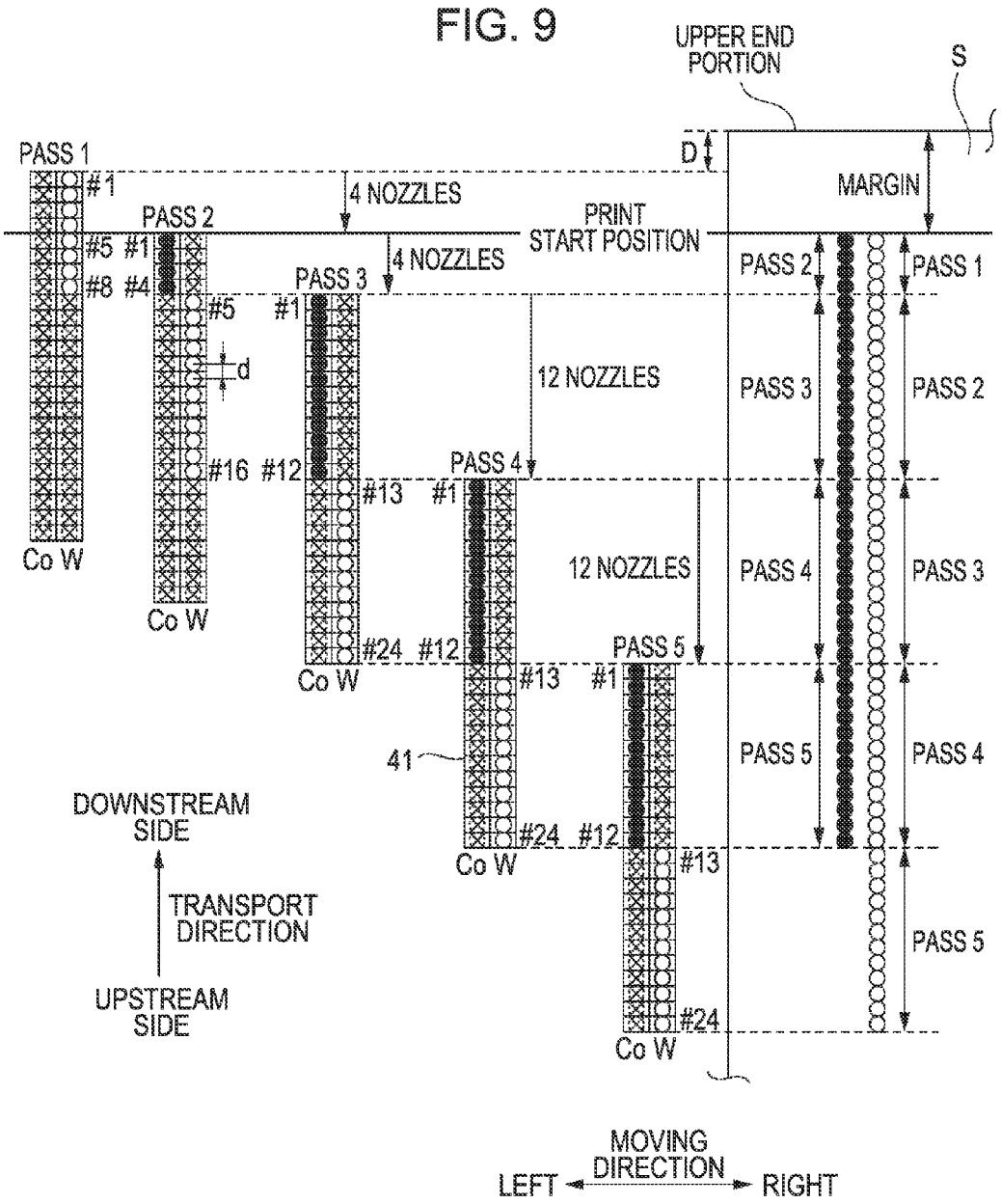
FIG. 9 is a diagram showing an aspect in which the upper end portion of the medium is printed in the band printing in a 5-color print mode of an embodiment of the invention.
Figure 10:
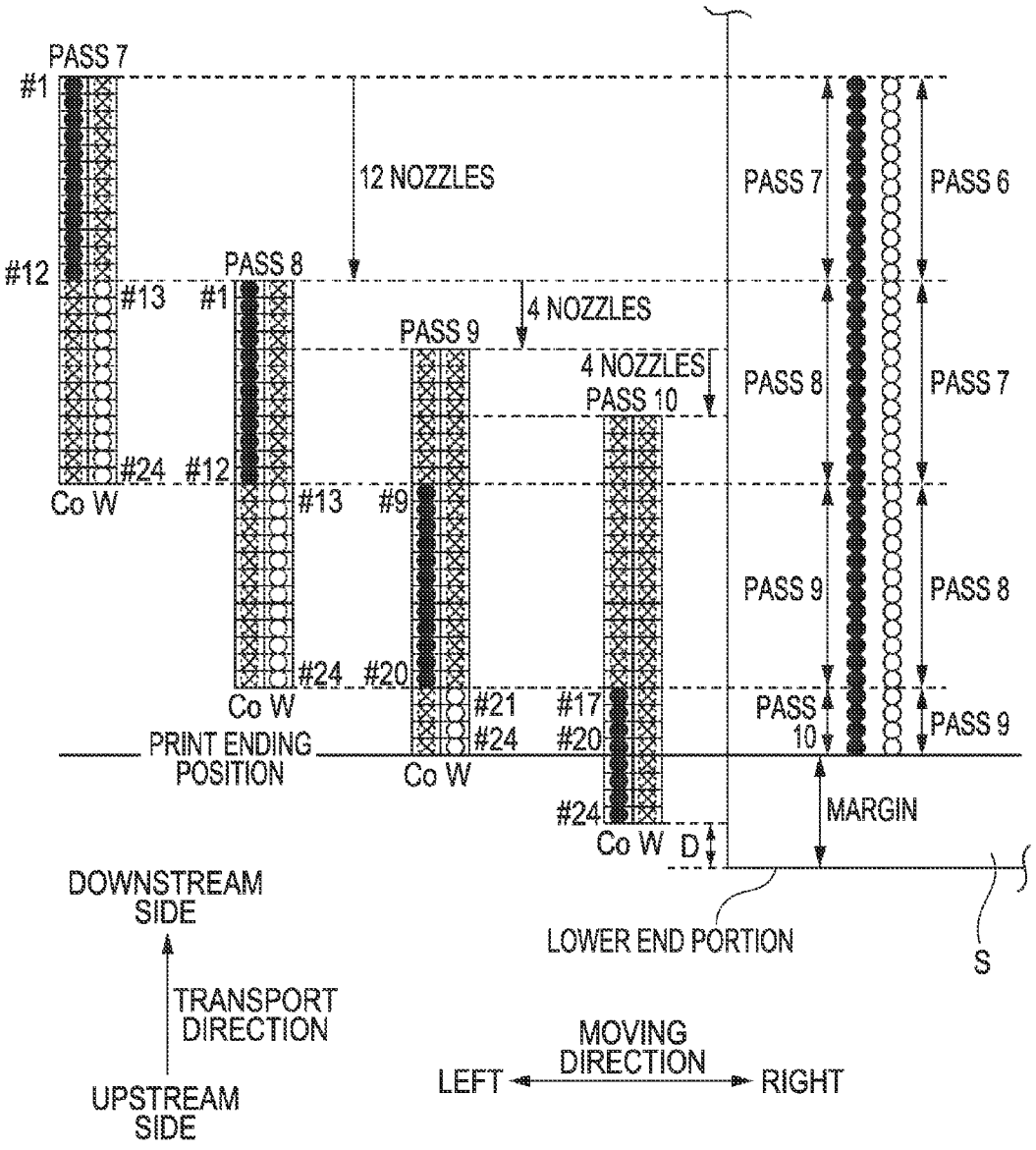
FIG. 10 is a diagram showing an aspect in which the lower end portion of the medium is printed in the band printing in the 5-color print mode of the embodiment.

FIG. 9 is a diagram showing an aspect in which the upper end portion of the medium S is printed in the band printing in the 5-color print mode of this embodiment, and FIG. 10 is a diagram showing an aspect in which the lower end portion of the medium S is printed in the band printing in the 5-color print mode of this embodiment. For simplification of explanation, the nozzles of each of the nozzle rows Co and W are depicted with the number thereof reduced to 24. The nozzle capable of ejecting ink in the color nozzle row Co is represented by a black circle, and the nozzle capable of ejecting ink in the white nozzle row W is represented by a white circle.

In the 5-color print mode of the comparative example described above (FIGS. 6A to 7B), the nozzles which print a background image are fixed to the nozzles (#13 to #24) of a half on the upstream side in the transport direction of the white nozzle row W, and the nozzles which print a color image are fixed to the nozzles (#1 to #12) of a half on the downstream side in the transport direction of the color nozzle row Co.

On the contrary, in the 5-color print mode of this embodiment, the nozzles on the downstream side in the transport direction of the white nozzle row W are also used for the printing of a background image. Similarly, the nozzles on the upstream side in the transport direction of the color nozzle row Co are also used for the printing of a color image.

First, the printing of the upper end portion of the medium S is specifically explained. As shown in FIG. 9, the paper feed position at the time of the start of the printing is a position where the upper end portion of the medium S is shifted to the downstream side in the transport direction a length D farther than the end portion on the downstream side in the transport direction of the head 41 of Pass 1. Then, in this embodiment, in Pass 1, eight nozzles (#1 to #8) on the downstream side of the white nozzle row W are set to be the ejection-able nozzles (the nozzles usable in the printing). However, since the medium S is transported by four nozzles (4d, 4 frames) after Pass 1, in Pass 1, a background image is printed by ejecting ink droplets from four nozzles (#5 to #8) on the upstream side in the transport direction among the ejection-able nozzles (#1 to #8). Also, in Pass 1, from the color nozzle row Co, ink droplets are not ejected.

In subsequent Pass 2, ink droplets are ejected from four nozzles #1 to #4 on the downstream side in the transport direction of the color nozzle row Co. A medium position facing the nozzles #1 to #4 of the color nozzle row Co of Pass 2 and a medium position facing the nozzles #5 to #8 of the white nozzle row W of the previous Pass 1 are the same. Therefore, on the background image printed by Pass 1, a color image can be printed in Pass 2. On the other hand, in Pass 2, a background image is printed by twelve nozzles #5 to #16 of the white nozzle row W. Thereafter, the medium S is transported by four nozzles.

In Pass 3, ink droplets are ejected from the nozzles (#1 to #12) of a half on the downstream side in the transport direction of the color nozzle row Co, and ink droplets are ejected from the nozzles (#13 to #24) of a half on the upstream side in the transport direction of the white nozzle row W. Since a medium position facing the nozzles #1 to #12 of the color nozzle row Co of Pass 3 and a medium position facing the nozzles #5 to #16 of the white nozzle row W of Pass 2 are the same, on the background image printed in Pass 2, a color image can be printed in Pass 3. Thereafter, the medium S is transported by twelve nozzles to the downstream side in the transport direction.

Thereafter (Pass 4 and after it), an operation for printing a color image by the nozzles (#1 to #12) of a half on the downstream side in the transport direction of the color nozzle row Co and printing a background image by the nozzles (#13 to #24) of a half on the upstream side in the transport direction of the white nozzle row W and an operation for transporting the medium S by twelve nozzles are alternately repeated. By doing so, on the background image formed in the previous pass, a color image can be printed in the subsequent pass.

In this manner, the printing which is performed by changing the number of nozzles used, the positions of the nozzles, or a transport amount of the medium in order to form dots on the upper end portion (the portion on the downstream side in the transport direction) of the medium S in the same way as that in a normal portion (the central portion) of the medium S is called "upper end printing". On the other hand, the printing which is performed in a state where the number of nozzles used, the positions of the nozzles, or a transport amount of the medium is constant is called "normal printing". Here, a pass in which the number of nozzles used or the positions of the nozzles are different from those in the normal printing is set to be the upper end printing, and in a case where a transport amount of the medium after a certain pass is different from that in the normal printing, the pass is set to be the upper end printing. Therefore, in FIG. 9, an operation from Pass 1 to a transport operation after Pass 2 corresponds to the upper end printing (the time of the image formation of the upper end portion of the medium), and an operation in Pass 3 and after it corresponds to the normal printing (the time of normal image formation).

Summarizing the aforesaid, at the time of the normal printing of this embodiment, the nozzles for printing a background image are set to be the nozzles (#13 to #24) of a half on the upstream side in the transport direction of the white nozzle row W, and the nozzles for printing a color image are set to be the nozzles (#1 to #12) of a half on the downstream side in the transport direction of the color nozzle row Co. In addition, the setting of the number of nozzles which print each of a background image and a color image at the time of the normal printing is not limited to the number of nozzles (in the drawing, 12) of a half of the nozzle row. By making at least the nozzles for printing a background image be located further on the upstream side in the transport direction than the nozzles for printing a color image, it is possible to print a color image on a background image in a pass after the pass in which the background image has been printed.

Then, at the time of the upper end printing of this embodiment, a background image is printed by using the nozzles different from the nozzles (#13 to #24) which print a background image at the time of the normal printing. Additionally speaking, the nozzles which print a background image at the time of the upper end printing of this embodiment are set to be nozzles which are located further on the downstream side in the transport direction than the nozzles which print a background image at the time of the normal printing.

In addition, in a case where the controller 10 in the printer 1 assigns data for printing the upper end portion of the medium to the nozzles on the downstream side in the transport direction of the white nozzle row W, the controller 10 corresponds to the control section and a single body of the printer 1 corresponds to the fluid ejecting apparatus. However, the invention is not limited thereto, but in a case where a printer driver in the computer 60 connected to the printer 1 assigns data for printing the upper end portion of the medium to the nozzles on the downstream side in the transport direction of the white nozzle row W, the computer 60 and the controller 10 of the printer 1 correspond to the control section and a printing system in which the computer 60 and the printer 1 are connected to each other corresponds to the fluid ejecting apparatus.

As a result, in the comparative example (FIG. 6A), the position of the raster line which is formed by the nozzle #13 of the head 41 of Pass 1 is the print start position, whereas in this embodiment, as shown in FIG. 9, the position of the raster line which is formed by the nozzle #5 of the head 41 of Pass 1 is the print start position (a thick line). Therefore, in this embodiment, it is possible to make the print start position be further on the downstream side in the transport direction than that in the comparative example, so that the position control range of the medium S can be shortened. As a result, a margin amount of the medium S can become smaller. Specifically, in the comparative example, the total amount of the protrusion amount D of the upper end portion of the medium from the head 41 at the time of the start of the printing and a length for twelve nozzles becomes a margin, whereas in this embodiment, the total amount of the protrusion amount D of the upper end portion of the medium from the head 41 at the time of the start of the printing and a length for four nozzles becomes a margin.

Also, in the case of the printer in which the paper feed position (head poking position) of the medium S is variable, in the upper end printing of this embodiment, since it is possible to make the print start position be on the downstream side in the transport direction with respect to the head 41, it is possible to start the printing at the paper feed position shown in FIG. 8A. Also from this, it can be found that in this embodiment, compared to the comparative example (FIG. 8B), the position control range of the medium S is shortened.

Also, in the comparative example (FIGS. 6A and 6B), the nozzles for printing a background image are fixed to the nozzles (#13 to #24) of a half on the upstream side in the transport direction of the white nozzle row W. Therefore, in the comparative example, from the nozzles (#1 to #12) of a half on the downstream side in the transport direction of the white nozzle row W, ink droplets are not ejected. Hence, there is a fear that in the nozzles (#1 to #12) of a half on the downstream side in the transport direction of the white nozzle row W, thickening of ink progresses, thereby generating an ejection defect. On the contrary, in this embodiment, in order to print a background image, not only the nozzles of a half on the upstream side in the transport direction of the white nozzle row W, but also the nozzles on the downstream side in the transport direction are used. Therefore, thickening of ink in the nozzles on the downstream side in the transport direction of the white nozzle row W can be prevented. That is, in this embodiment, compared to the comparative example, since not only the nozzles on the upstream side of the white nozzle row W, but also the nozzles on the downstream side are used, thickening of ink can be prevented.

Also, in the case of using only the nozzles on the upstream side of the white nozzle row W like the comparative example, if a nozzle which generates an ejection defect exists in the nozzles on the upstream side, the printing is severely affected by the nozzle which generates an ejection defect. On the contrary, as in this embodiment, by using not only the nozzles on the upstream side, but also the nozzles on the downstream side, thereby using many kinds of nozzles, a difference in characteristic between nozzles can be alleviated.

Next, the printing of the lower end portion of the medium S will be specifically explained by using FIG. 10. In addition, in FIG. 10, the printing is set to be finished in Pass 10. An operation up to Pass 7 is the normal printing (the time of the normal image formation), and an operation for printing a color image by the nozzles (#1 to #12) of a half on the downstream side in the transport direction of the color nozzle row Co and printing a background image by the nozzles (#13 to #24) of a half on the upstream side in the transport direction of the white nozzle row W and an operation for transporting the medium S by twelve nozzles are repeated.

In Pass 8, after the printing of images by the nozzles of a half on the downstream side in the transport direction of the color nozzle row Co and the nozzles of a half on the upstream side in the transport direction of the white nozzle row W, the medium S is transported by four nozzles. Then, in Pass 9, a color image is printed by twelve nozzles #9 to #20 of the color nozzle row Co, and a background image is printed by four nozzles #21 to #24 of the white nozzle row W. A medium position facing the nozzles #9 to #20 of the color nozzle row Co of Pass 9 and a medium position facing the nozzles #13 to #24 of the white nozzle row W of the previous Pass 8 are the same. Therefore, on the background image printed in Pass 8, a color image can be printed in Pass 9. Thereafter, the medium S is transported by four nozzles.

In Pass 10, eight nozzles (#17 to #24) on the upstream side in the transport direction of the color nozzle row Co are set to the ejection-able nozzles. However, in the previous Pass 9, a background image is printed only by four nozzles (#21 to #24) of the white nozzle row W. Therefore, ink is ejected from four nozzles (#17 to #20) on the downstream side in the transport direction among eight ejection-able nozzles (#17 to #24) of the color nozzle row Co of Pass 10. As a result, on the background image formed in Pass 9, a color image can be printed in Pass 10. Also, in Pass 10, from the white nozzle row W, ink droplets are not ejected.

In this manner, in order to form dots on the lower end portion of the medium S in the same way as that in the upper end portion or the normal portion of the medium, the printing is carried out by changing the number of nozzles used, the positions of the nozzles, or a transport amount of the medium.

This is called "lower end printing". Here, a pass in which the number of nozzles used or the positions of the nozzles are different from those in the normal printing is set to be the lower end printing, and in a case where a transport amount of the medium after a certain pass is different from that in the normal printing, the pass is set to be the lower end printing. Therefore, in FIG. 10, an operation up to Pass 7 corresponds to the normal printing, and an operation from Pass 8 to Pass 10 corresponds to the lower end printing (the time of the image formation of the lower end portion of the medium).

Summarizing the aforesaid, at the time of the lower end printing of this embodiment, a color image is printed by using the nozzles different from the nozzles (#1 to #12) of the color nozzle row Co, which print a color image at the time of the normal printing. Additionally speaking, the nozzles which print a color image at the time of the lower end printing of this embodiment are set to be nozzles which are located further on the upstream side in the transport direction than the nozzles which print a color image at the time of the normal printing.

As a result, in the comparative example (FIG. 7B), the position of the raster line which is formed by the nozzle #12 of the head 41 of final Pass X becomes the print ending position, whereas in this embodiment, as shown in FIG. 10, the position of the raster line which is formed by the nozzle #20 of the head 41 of final Pass 10 becomes the print ending position (a thick line). Therefore, in this embodiment, it is possible to make the print ending position be further on the upstream side in the transport direction than that in the comparative example, so that the position control range of the medium S can be shortened. As a result, a margin amount of the medium S can become smaller. Specifically, in the comparative example, the total amount of the protrusion amount D of the lower end portion of the medium from the head 41 at the time of the ending of the printing and a length for twelve nozzles becomes a margin, whereas in this embodiment, the total amount of the protrusion amount D of the lower end portion of the medium from the head 41 at the time of the ending of the printing and a length for four nozzles becomes a margin.

Also, in the case of a printer in which the paper discharge position of the medium S is variable, in the lower end printing of this embodiment, since it is possible to make the print ending position be on the upstream side in the transport direction with respect to the head 41, the printing can be finished at the paper discharge position shown in FIG. 8A. Also from this, it can be found that in this embodiment, compared to the comparative example (FIG. 8B), the position control range of the medium is shortened.

Also, in the comparative example, since the nozzles (#13 to #24) of a half on the upstream side in the transport direction of the color nozzle row Co are not used for the printing, there is a fear that ink in the nozzles on the upstream side is thickened, thereby generating an ejection defect. On the contrary, in this embodiment, since the nozzles on the upstream side in the transport direction of the color nozzle row Co are also used for the printing, an ejection defect can be prevented. Also, in this embodiment, not only the nozzles on the downstream side of the color nozzle row Co, but also the nozzles on the upstream side are used, so that many kinds of nozzles are used. Therefore, a difference in characteristic between nozzles can be alleviated.

That is, in the 5-color print mode of this embodiment, at the time of the normal printing, the nozzles which print a background image are set to be the nozzles on the upstream side in the transport direction and the nozzles which print a color image are set to be the nozzles on the downstream side in the transport direction. However, at the time of the upper end printing and the time of the lower end printing, the nozzles which print a background image and a color image are set to be different. At the time of the upper end printing, compared to the time of the normal printing, by setting the nozzles for printing a background image to be the nozzles on the downstream side in the transport direction, the print start position is made to be on the downstream side in the transport direction. Also, at the time of the lower end printing, compared to the normal printing, by setting the nozzles for printing a color image to be the nozzles on the upstream side in the transport direction, it is possible to make the print ending position be on the upstream side in the transport direction. As a result, the position control range of the medium can be shortened, so that it is possible to make it difficult for a transport error to be generated or to reduce a margin amount. Also, since not only some nozzles, but more kinds of nozzles are used, thickening of ink or a difference in characteristic between nozzles can be alleviated.

In addition, as shown in FIG. 9, at the time of the upper end printing, the ejecting nozzles of the white nozzle row W are shifted to the upstream side in the transport direction in accordance with the progress of the printing. Specifically, in Pass 1, the nozzles #1 to #8 of the white nozzle row W are the ejection-able nozzles, in Pass 2, the nozzles #5 to #16 of the white nozzle row W are the ejection-able nozzles, and finally (Pass 3 and after it), the nozzles #13 to #24 of a half on the upstream side in the transport direction of the white nozzle row W become the ejection-able nozzles. Also, at the time of the upper end printing, in accordance with the transition of the ejection-able nozzles of the white nozzle row W to the upstream side in the transport direction, the ejection-able nozzles of the color nozzle row Co are also increased to the upstream side in the transport direction. By doing so, the transition from the upper end printing to the normal printing is possible, so that on the background image printed in the prior pass, a color image can be printed in the posterior pass.

Also, in this embodiment, at the time of the upper end printing, by gradually shifting the ejection-able nozzles of the white nozzle row W to the upstream side in the transport direction, the time after the printing of a background image and until the printing of a color image thereon is made to be the same as that at the time of the normal printing. At the time of the normal printing, a background image is printed in the previous pass and a color image is printed on the background image in the subsequent pass.

For example, in Pass 1, the nozzles up to the nozzle #8 are set to be the ejection-able nozzles. However, in Pass 1, it is also possible to print a background image by the nozzles (#9 to #24) further on the downstream side than it. However, if a background image is also printed by the nozzle #9 and the nozzles on the downstream side thereof in Pass 1, it is not necessary to print a background image by the nozzles #5 to #16 in Pass 2, so that on the background image formed by the nozzle #9 and the nozzles on the downstream side thereof in Pass 1, a color image is printed in Pass 3 which is the normal printing. In this case, since a color image is printed with one pass skipped after the printing of a background image, the time after the printing of a background image and until the printing of a color image becomes different at the time of the upper end printing and the time of the normal printing. In this manner, if there is a variation in the time after the printing of a background image and until the printing of a color image, the drying time of the background image varies, so that the drying state of the background image (the bleeding state of the color image) when printing the color image varies. As a result, density unevenness of an image is generated. Therefore, in this embodiment, the time after the printing of a background image and until the printing of a color image is set to be constant.

Therefore, it is preferable to perform the upper end printing by a printing method which is as close to that at the time of the normal printing as possible. At the time of the normal printing, an operation for ejecting ink droplets from fixed twelve nozzles (#13 to #24) of the white nozzle row W and an operation for transporting the medium S by twelve nozzles are repeated. That is, a positional relationship between the ejection-able nozzles (#13 to #24) and the medium is shifted to the transport direction by twelve nozzles for every pass. Therefore, at the time of the upper end printing, a transport amount of the medium S after Pass 1 is set to be four nozzles, and the ejection-able nozzle (for example, #16) of Pass 2 is shifted by eight nozzles from the ejection-able nozzle (for example, #8) of Pass 1. Similarly, a transport amount of the medium S after Pass 2 is set to be four nozzles, and the ejection-able nozzle (for example, #24) of Pass 3 is shifted by eight nozzles from the ejection-able nozzle (for example, #16) of Pass 2. By doing so, also at the time of the upper end printing, similarly to the time of the normal printing, a positional relationship between the ejection-able nozzles and the medium is shifted to the transport direction by twelve nozzles for every pass. That is, the total amount of a shift amount of the ejection-able nozzle to the upstream side in the transport direction for every pass at the time of the upper end printing (the first nozzle for forming the first image) and a transport amount of the medium S at the time of the upper end printing is made to be the same as a transport amount of the medium S at the time of the normal printing. Further, in this embodiment, by making a shift amount of the ejection-able nozzle to the upstream side in the transport direction at the time of the upper end printing constant, the nozzles on the downstream side in the transport direction of the white nozzle row W can be averagely used. Also, by making a shift amount of the ejection-able nozzle to the upstream side in the transport direction at the time of the upper end printing constant, a transport amount of the medium S becomes constant. As a result, the transport operation can be stabilized, so that printing control can be easily performed.

Similarly, also at the time of the lower end printing, as shown in FIG. 10, the ejecting nozzles of the color nozzle row Co are shifted to the upstream side in the transport direction in accordance with the progress of the printing. Specifically, in Pass 8, the nozzles #1 to #12 of the color nozzle row are the ejection-able nozzles, in Pass 9, the nozzles #9 to #20 of the color nozzle row Co are the ejection-able nozzles, and in Pass 10, the nozzles #17 to #24 of the color nozzle row Co become the ejection-able nozzles. Also, at the time of the lower end printing, in accordance with the transition of the ejection-able nozzles of the color nozzle row Co to the upstream side in the transport direction, the ejection-able nozzles of the white nozzle row W are reduced to the upstream side in the transport direction. By doing so, the transition from the normal printing to the lower end printing is possible, so that on a background image printed in the prior pass, a color image can be printed in the posterior pass.

Also in the lower end printing, the total amount of a shift amount of the ejection-able nozzle of the color nozzle row Co to the upstream side in the transport direction and a transport amount of the medium S is made to be the same as a transport amount of the medium S at the time of the normal printing. For example, a transport amount of the medium S after Pass 8 is set to be four nozzles, and the ejection-able nozzle (for example, #20) of Pass 9 is shifted by eight nozzles from the ejection-able nozzle (for example, #12) of Pass 8. By doing so, also at the time of the lower end printing, a positional relationship between the ejection-able nozzles and the medium is shifted to the transport direction by twelve nozzles for every pass. By doing so, also at the time of the lower end printing, similarly to the time of the normal printing, it is possible to print a color image in the pass following the pass in which a background image is printed. As a result, the time after the printing of a background image and until the printing of a color image can become constant at the time of the normal printing and the time of the lower end printing, so that density unevenness of an image can be suppressed. Also, by making a shift amount of the ejection-able nozzle to the upstream side in the transport direction at the time of the lower end printing constant, the nozzles on the upstream side in the transport direction of the color nozzle row Co can be averagely used. Also, by making a shift amount of the ejection-able nozzle to the upstream side in the transport direction at the time of the lower end printing constant, a transport amount of the medium S becomes constant. As a result, a transport operation can be stabilized, so that printing control can be easily performed.

However, not only by making the total amount of a shift amount of the ejection-able nozzle to the upstream side in the transport direction at the time of the upper end printing (or the time of the lower end printing) and a transport amount of the medium S be the same as a transport amount of the medium S at the time of the normal printing, but by making the time after the printing of a background image and until the printing of a color image be the same as that at the time of the upper end printing (or the time of the lower end printing) and the time of the normal printing density unevenness of an image can be prevented.

Concerning Overlap Printing

Next, the upper end printing and the lower end printing in the case of performing "overlap printing" in the 5-color print mode (a mode in which a color image is printed on a background image of white ink) will be explained. The overlap printing is a printing method in which one raster line (a dot row along the moving direction) is formed by a plurality of nozzles. According to the overlap printing, even if there is a nozzle which generates an ejection defect or a nozzle in which the ejected ink carries out a curved flight due to a manufacturing error or the like, since one raster line is formed by a plurality of nozzles, a difference in characteristic between nozzles can be alleviated. As a result, deterioration of an image quality can be suppressed. In the following explanation, the overlap printing in which one raster line is formed by two nozzles will be taken and explained as an example. Also, the raster lines are printed to be arranged in the transport direction at intervals narrower than the nozzle pitch d. In addition, although the 4-color print mode (a mode in which a color image is directly printed on a medium) is not explained in detail, the overlap printing is performed by using the whole of the color nozzle row Co.

5-Color Print Mode of Comparative Example

Figure 11:
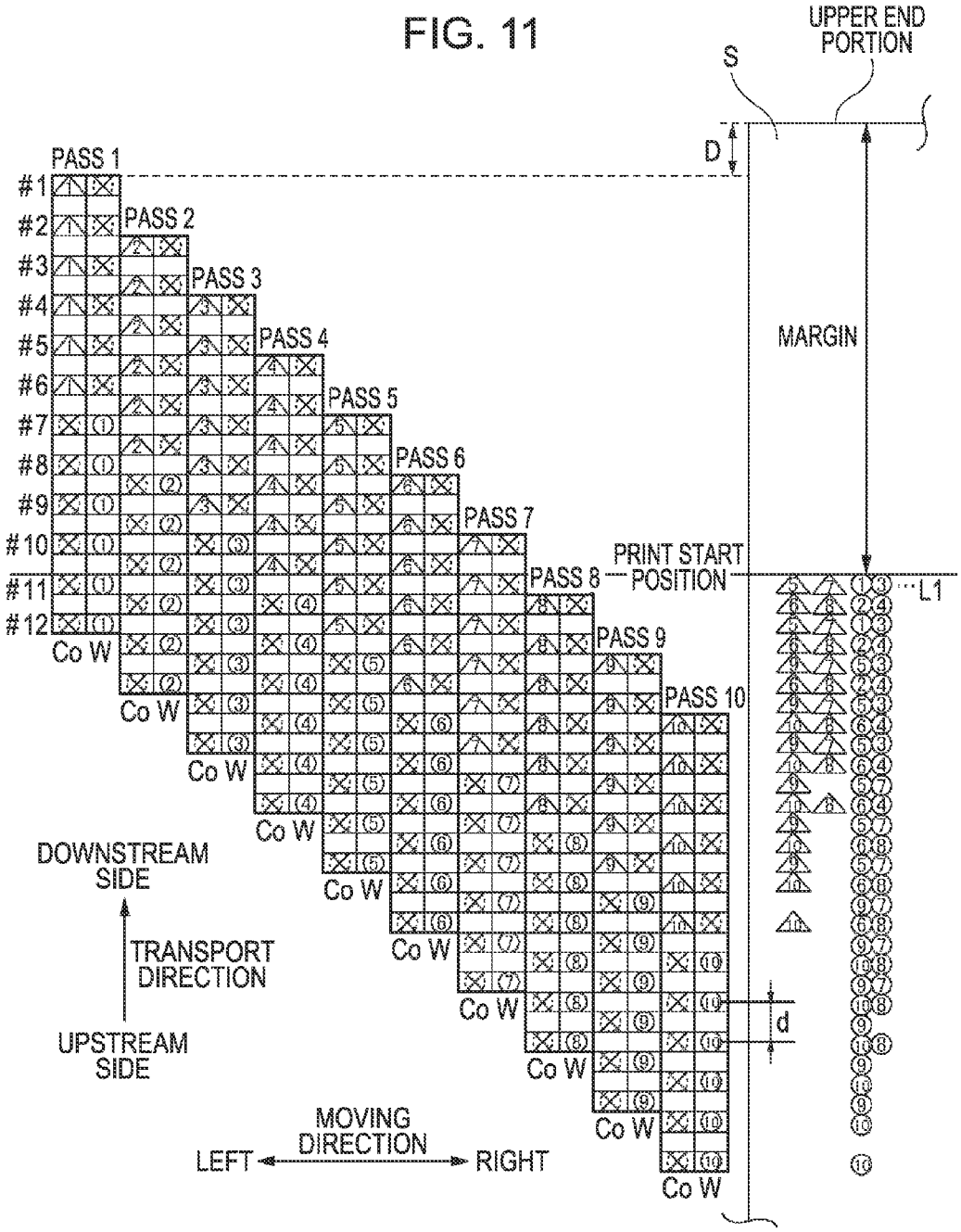
FIG. 11 is a diagram showing an aspect in which the upper end portion of the medium is printed by overlap printing in the 5-color print mode of the comparative example.
Figure 12:
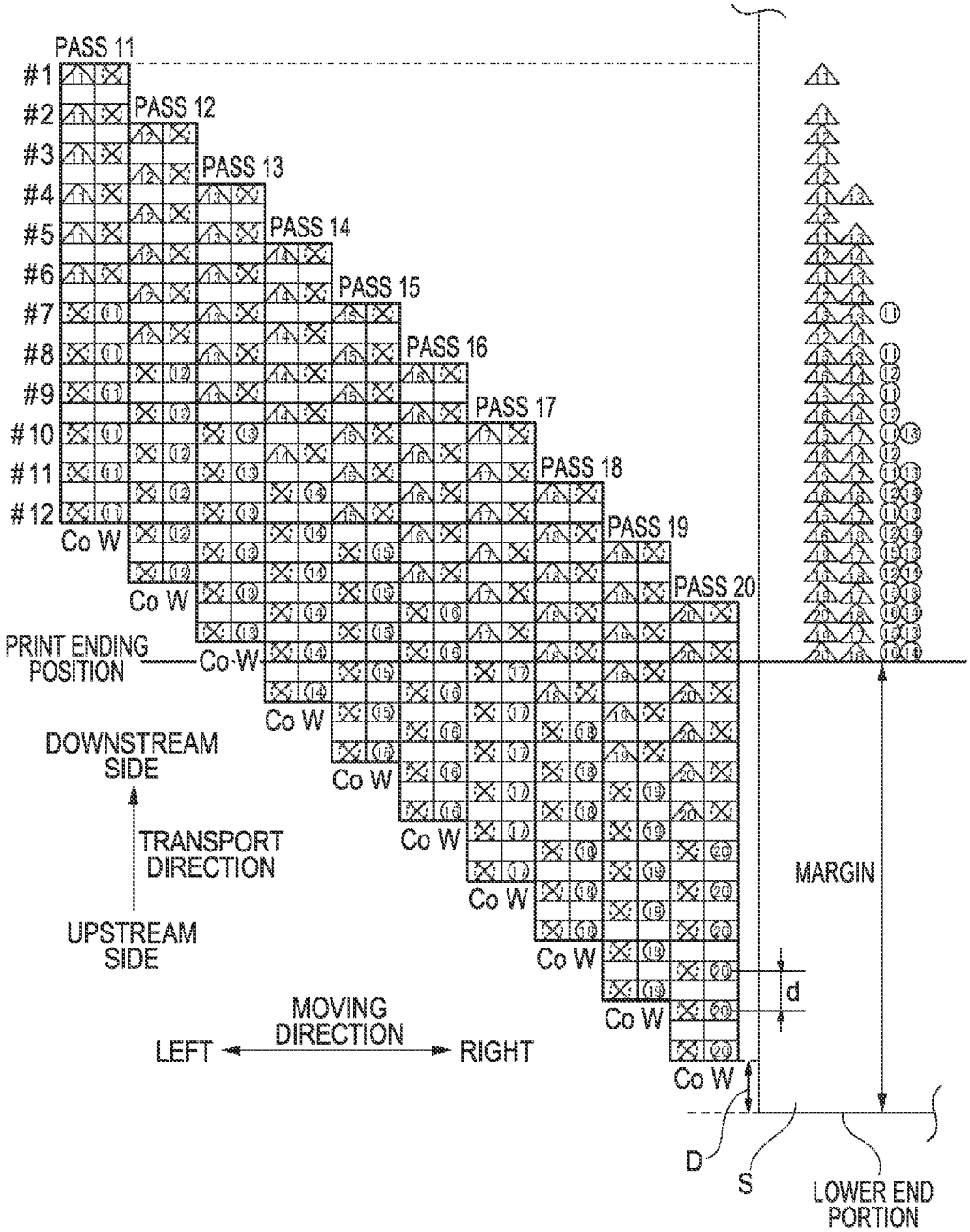
FIG. 12 is a diagram showing an aspect in which the lower end portion of the medium is printed by the overlap printing in the 5-color print mode of the comparative example.

FIG. 11 is a diagram showing an aspect in which the upper end portion of the medium S is printed by the overlap printing in the 5-color printing mode of the comparative example, and FIG. 12 is a diagram showing an aspect in which the lower end portion of the medium S is printed by the overlap printing in the 5-color printing mode of the comparative example. For simplification of explanation, the nozzles are depicted with the number thereof reduced to 12 (#1 to #12). The nozzles belonging to the color nozzle row Co (=YMCK) and dots of color ink are represented by a triangle, and the nozzles belonging to the white nozzle row W and dots of white ink are represented by a circle. Also, a numeral stated in the circle or the triangle representing the nozzle or the dot is the pass number.

As described above, in the 5-color print mode of the comparative example, the nozzles for printing a background image are set to be the nozzles (#7 to #12) of a half on the upstream side in the transport direction of the white nozzle row W, and the nozzles for printing a color image are set to be the nozzles (#1 to #6) of a half on the downstream side in the transport direction of the color nozzle row Co. Then, from the nozzles (#1 to #6) of a half on the downstream side in the transport direction of the white nozzle row W and the nozzles (#7 to #12) of a half on the upstream side in the transport direction of the color nozzle row Co, ink is not ejected.

Next, a concrete printing method (the printing method of the upper end portion of the medium S) will be explained. In the comparative example, a transport amount of the medium S is set to be a "1.5d (=3 frames)" which is 1.5 times the nozzle pitch d (=2 frames). As shown in FIG. 11, at the time of the start of the printing (the paper feed position thereof), the upper end portion of the medium S is in a state where it is located on the downstream side in the transport direction a length D farther than the end portion on the downstream side in the transport direction of the head 41 (of Pass 1). Then, since a thick line of FIG. 11 is the print start position, in Pass 1, a background image is printed by two nozzles #11 and #12 on the upstream side in the transport direction of the white nozzle row W. In pass 1, from the color nozzle row Co, ink is not ejected. Thereafter, the medium S is transported by 1.5d (3 frames).

In Pass 2, a background image is printed by three nozzles #10 to #12 of the white nozzle row W, in Pass 3, a background image is printed by five nozzles #8 to #12 of the white nozzle row W, and in Pass 4, a background image is printed by six nozzles #7 to #12 of the white nozzle row W. Thereafter, in Pass 5, an image is printed by two nozzles #5 and #6 of the color nozzle row Co and six nozzles #7 to #12 of the white nozzle row W, in Pass 6, an image is printed by three nozzles #4 to #6 of the color nozzle row Co and six nozzles #7 to #12 of the white nozzle row W, and in Pass 7, an image is printed by five nozzles #2 to #6 of the color nozzle row Co and six nozzles #7 to #12 of the white nozzle row W.

In the subsequent pass, an operation for forming an image by the nozzles (#1 to #6) of a half on the upstream side in the transport direction of the color nozzle row Co and the nozzles (#7 to #12) of a half on the downstream side in the transport direction of the white nozzle row W and an operation for transporting the medium S by 1.5d are alternately repeated.

As a result, it is possible to print a color image on a background image in a different posterior pass. Also, as shown in the right drawing of FIG. 11, one raster line is formed by dots by two kinds of nozzles of the white nozzle row W and dots by two kinds of nozzles of the color nozzle row Co. For example, at a raster line L1 on the most downstream side (the upper end side) in the transport direction, a background image is printed by Passes 1 and 3 and a color image is printed by subsequent Passes 5 and 7.

As shown in FIG. 11, in the overlap printing in the 5-color print mode of the comparative example, the position of the raster line which is formed by the nozzle #11 of the white nozzle row W in a state where the upper end portion of the medium S is protruded by a length D from the head 41 at the time of the start of the printing becomes the print start position. That is, the print start position is on the upstream side in the transport direction with respect to the head 41, so that the position control range of the medium S becomes longer and a margin amount of the medium S becomes larger. Also, in the comparative example, since ink droplets are not ejected from the nozzles (#1 to #6) on the downstream side in the transport direction of the white nozzle row W, there is a fear that thickening of ink occurs, thereby generating an ejection defect.

Next, as shown in FIG. 12, a printing method of the lower end portion of the medium S will be explained. Here, Pass 20 is set to be a final pass. Up to Pass 13, an operation for forming an image by the nozzles (#1 to #6) of a half on the downstream side in the transport direction of the color nozzle row Co and the nozzles (#7 to #12) of a half on the upstream side in the transport direction of the white nozzle row W and an operation for transporting the medium S by 1.5d are alternately repeated. Then, in Pass 14 and after it, the number of nozzles which eject ink droplets is gradually reduced.

In Pass 14, an image is printed by six nozzles #1 to #6 of the color nozzle row Co and five nozzles #7 to #11 of the white nozzle row W, in Pass 15, an image is printed by six nozzles #1 to #6 of the color nozzle row Co and three nozzles #7 to #9 of the white nozzle row W, and in Pass 16, an image is printed by six nozzles #1 to #6 of the color nozzle row Co and two nozzles #7 and #8 of the white nozzle row W. Thereafter, in Pass 17, a color image is printed by six nozzles #1 to #6 of the color nozzle row Co, in Pass 18, a color image is printed by five nozzles #1 to #5 of the color nozzle row Co, in Pass 19, a color image is printed by three nozzles #1 to #3 of the color nozzle row Co, in Pass 20, a color image is printed by two nozzles #1 and #2 of the color nozzle row Co, and then the printing is finished.

As shown in FIG. 12, at the time of the lower end printing of the comparative example, the position of the raster line which is formed by the nozzle #2 of the color nozzle row Co in a state where the lower end portion of the medium S is protruded by a length D from the head 41 at the time of the ending of the printing becomes the print ending position. That is, the print ending position is on the downstream side in the transport direction with respect to the head 41, so that the position control range of the medium S becomes longer and a margin amount of the medium S becomes larger. Also, in the comparative example, since ink droplets are not ejected from the nozzles (#7 to #12) on the upstream side in the transport direction of the color nozzle row Co, there is a fear that thickening of ink occurs, thereby generating an ejection defect.

Therefore, also in the overlap printing in the 5-color print mode of the comparative example, a target is to make the position control range of the medium S as short as possible.

5-Color Print Mode of this Embodiment

Figure 13:
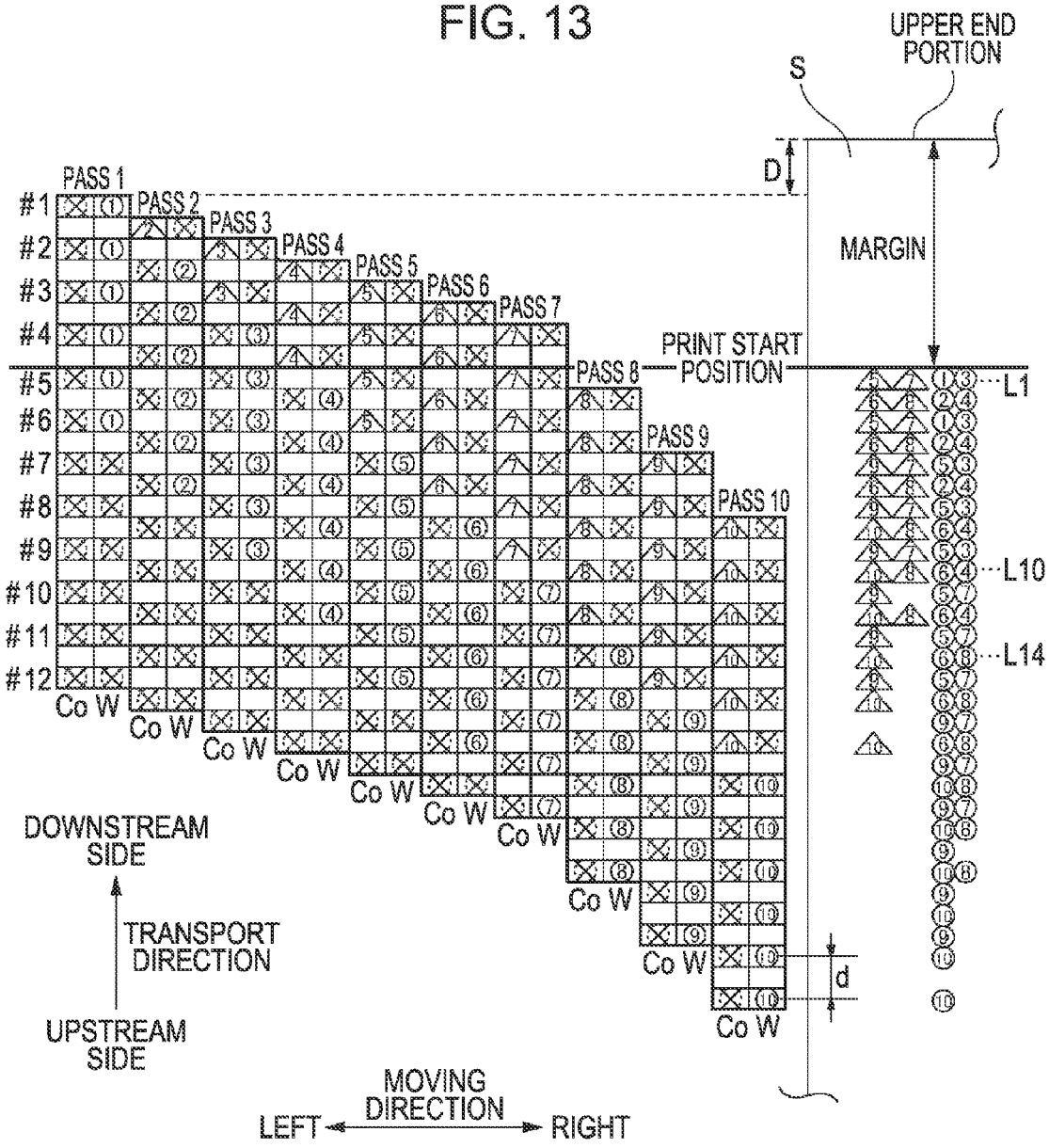
FIG. 13 is a diagram showing an aspect in which the upper end portion of the medium is printed in the overlap printing in the 5-color print mode of the embodiment.
Figure 14:
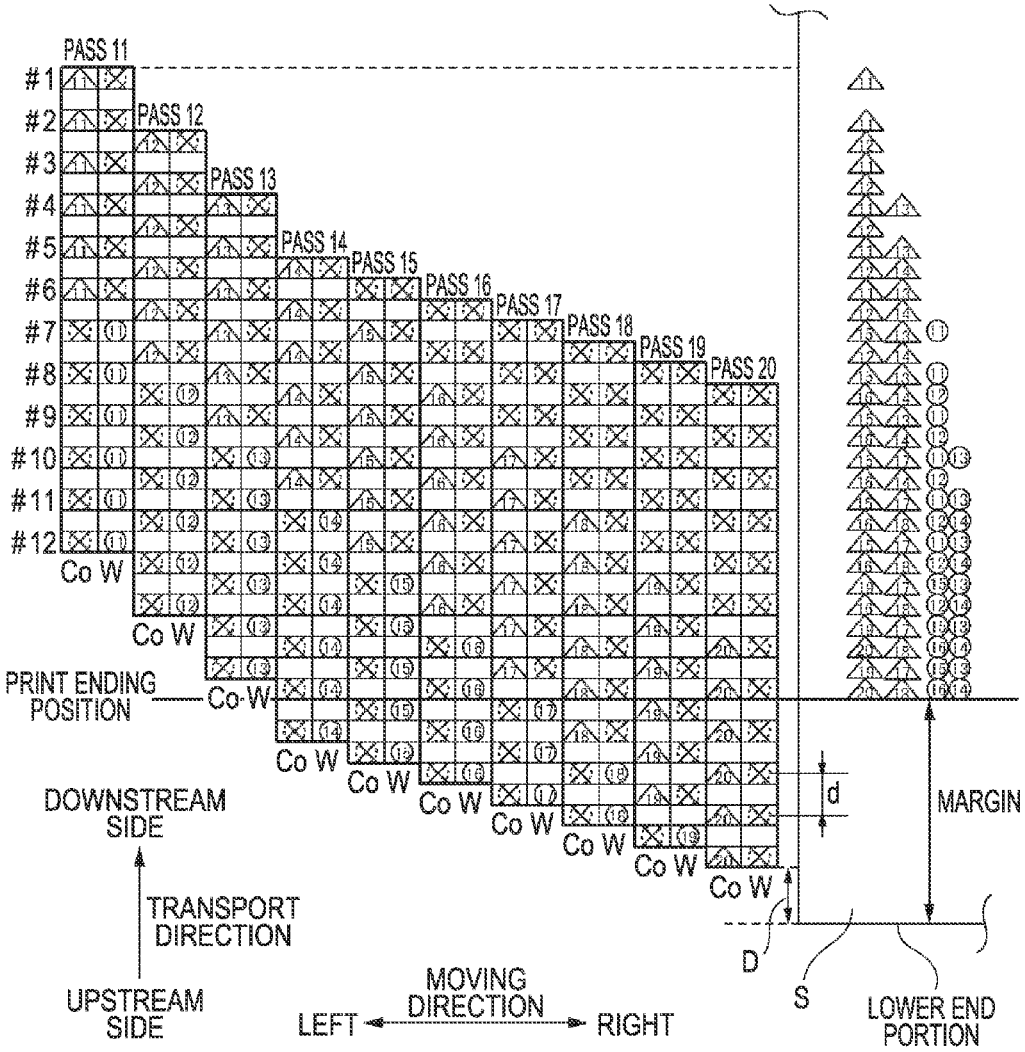
FIG. 14 is a diagram showing an aspect in which the lower end portion of the medium is printed in the overlap printing in the 5-color print mode of the embodiment.

FIG. 13 is a diagram showing an aspect in which the upper end portion of the medium S is printed in the overlap printing in the 5-color printing mode of the embodiment, and FIG. 14 is a diagram showing an aspect in which the lower end portion of the medium S is printed in the overlap printing in the 5-color printing mode of the embodiment. In this embodiment, similarly to the above-described band printing, in order to make the position control range of the medium S as short as possible, a background image is printed by using also the nozzles on the downstream side in the transport direction without fixing the nozzle of the white nozzle row W for printing the background image to the nozzles of a half on the upstream side in the transport direction. Also, a color image is printed by using also the nozzles on the upstream side in the transport direction without fixing the nozzle of the color nozzle row Co for printing the color image to the nozzles on the downstream side in the transport direction.

First, the printing of the upper end portion of the medium S is specifically explained by using FIG. 13. The paper feed position at the time of the start of the printing is a position in which the upper end portion of the medium S is shifted to the downstream side in the transport direction a length D farther than the end portion on the downstream side in the transport direction of head 41 of Pass 1. In Pass 1, six nozzles (#1 to #6) from the most downstream side in the transport direction of the white nozzle row W are set to be the ejection-able nozzles. However, as shown in FIG. 13, since the position of the raster line which is formed by the nozzle #5 of the head 41 of Pass 1 becomes the print start position (a thick line), in Pass 1, a background image is printed by two nozzles #5 and #6 of the white nozzles row W. Also, in Pass 1, from the color nozzle row Co, ink droplets are not ejected. Thereafter, the medium S is transported by a length 0.5d (=1 frame) of a half of the nozzle pitch d.

In subsequent Pass 2, although the nozzles #2 to #7 of the white nozzle row W and the nozzle #1 of the color nozzle row Co are set to be the ejection-able nozzles, ink droplets are ejected from three nozzles #5 to #7 of the white nozzle row. Thereafter, the medium S is transported by half a nozzle pitch 0.5d. In this manner, in the overlap printing of this embodiment, in the white nozzle row W and the color nozzle row Co, the ejection-able nozzles are shifted one by one to the upstream side in the transport direction for every pass. However, ink droplets are ejected from the nozzles which are located further on the upstream side in the transport direction than the print start position (a thick line) in the drawing, among the ejection-able nozzles.

In Pass 3, although the nozzles #3 to #8 of the white nozzle row W and the nozzles #1 and #2 of the color nozzle row Co are set to be the ejection-able nozzles, ink droplets are ejected from the nozzles #4 to #8. In Pass 4, although the nozzles #4 to #9 of the white nozzle row W and the nozzles #1 to #3 of the color nozzle row Co are set to be the ejection-able nozzles, ink droplets are ejected from the nozzles #4 to #9. In Pass 5, although the nozzles #5 to #10 of the white nozzle row W and the nozzles #1 to #4 of the color nozzle row Co are set to be the ejection-able nozzles, ink droplets are ejected from the nozzles #3 to #10. In Pass 6, although the nozzles #6 to #11 of the white nozzle row W and the nozzles #1 to #5 of the color nozzle row Co are set to be the ejection-able nozzles, ink droplets are ejected from the nozzles #3 to #11. In Pass 7, although the nozzles #7 to #12 of the white nozzle row W and the nozzles #1 to #6 of the color nozzle row Co are set to be the ejection-able nozzles, ink droplets are ejected from the nozzles #2 to #12. Then, from Pass 1 to the front of Pass 7, a transport amount of the medium S is set to be half a nozzle pitch 0.5d.

As a result, it is possible to print a color image on a background image in a different posterior pass. Then, as shown in the right drawing of FIG. 13, one raster line is formed by dots by two kinds of nozzles of the white nozzle row W and dots by two kinds of nozzles of the color nozzle row Co.

Thereafter (Pass 8 and after it), an operation for printing a color image by the nozzles (#1 to #6) of a half on the downstream side in the transport direction of the color nozzle row Co and printing a background image by the nozzles (#7 to #12) of a half on the upstream side in the transport direction of the white nozzle row W and an operation for transporting the medium S by 1.5d (=3 frames) which is a length of 1.5 times the nozzle pitch are alternately repeated. By doing so, it is possible to print a color image on a background image in a posterior pass, so that one raster line is formed by dots by two kinds of the white nozzle row W and dots by two kinds of the color nozzle row Co.

As described above, here, a pass in which the number of nozzles used (the number of nozzles which eject ink) or the positions of the nozzles are different from those in the normal printing is set to be the upper end printing, and in a case where a transport amount of the medium after a certain pass is different from that in the normal printing, the pass is set to be the upper end printing. Therefore, in FIG. 13, an operation from Pass 1 to Pass 7 (the transport operation after it) corresponds to the upper end printing (the time of the image formation of the upper end portion of the medium), and an operation in Pass 8 and after it corresponds to the normal printing (the time of the normal image formation).

In this manner, also in the overlap printing, at the time of the upper end printing, a background image is printed by using the nozzles different from the nozzles (#7 to #12) which print a background image at the time of the normal printing. Additionally speaking, the nozzles which print a background image at the time of the upper end printing are set to be nozzles which are located further on the downstream side in the transport direction than the nozzles which print a background image at the time of the normal printing.

As a result, in the comparative example (FIG. 11), the position of the raster line which is formed by the nozzle #11 of the head 41 of Pass 1 becomes the print start position, whereas in this embodiment, as shown in FIG. 13, the position of the raster line which is formed by the nozzle #5 of the head 41 of Pass 1 becomes the print start position (a thick line). Therefore, in this embodiment, it is possible to make the print start position be further on the downstream side in the transport direction than that in the comparative example, so that the position control range of the medium S can be shortened, whereby a margin amount of the medium S can become smaller.

In addition, at the time of the upper end printing, the ejecting nozzles of the white nozzle row W are shifted to the upstream side in the transport direction in accordance with the progress of the printing. Also, at the time of the upper end printing, in accordance with the transition of the ejecting nozzles of the white nozzle row W to the upstream side in the transport direction, the ejecting nozzles of the color nozzle row Co are also increased to the upstream side in the transport direction. By doing so, a transition from the upper end printing to the normal printing is possible, so that on the background image printed in the prior pass, a color image can be printed in the posterior pass.

Also, in the comparative example, since the nozzles (#1 to #6) of a half on the downstream side in the transport direction of the white nozzle row W are not used for the printing, there is a fear that thickening of ink in the nozzles on the downstream side occurs, thereby generating an ejection defect. On the contrary, in this embodiment, since the nozzles on the downstream side in the transport direction of the white nozzle row W are also used for the printing, an ejection defect can be prevented. Also, in this embodiment, since not only the nozzles on the upstream side of the white nozzle row W, but also the nozzles on the downstream side are used, so that many kinds of nozzles are used, a difference in characteristic between nozzles can be alleviated.

Also, in order to make the dot formation methods at the time of the normal printing and the time of the upper end printing be the same, the total amount of a shift amount of the ejection-able nozzle to the upstream side in the transport direction for every pass at the time of the upper end printing and a transport amount of the medium S at the time of the upper end printing is made to be the same as a transport amount of the medium S at the time of the normal printing. At the time of the normal printing, a positional relationship between the ejection-able nozzles (#7 to #12) and the medium S is shifted to the transport direction by 1.5 nozzles (3 frames)

for every pass. On the other hand, at the time of the upper end printing, the ejection-able nozzles of the white nozzle row W are shifted one by one to the upstream side in the transport direction in accordance with the progress of the printing. That is, at the time of the upper end printing, a transport amount of the medium S is half a nozzle (1 frame), and the position of the ejection-able nozzle is shifted by one nozzle (2 frames) to the upstream side in the transport direction for every pass. As a result, also at the time of the upper end printing, similarly to the time of the normal printing, a positional relationship between the ejection-able nozzles and the medium S is shifted by 1.5 nozzles (3 frames) for every pass.

This can also be found from the fact that a relative position of the nozzle on the most upstream side among the ejection-able nozzles of the white nozzle row W to the medium S is shifted by 3 frames (1.5 nozzles) for every pass not only at the time of the upper end printing (Pass 1 to Pass 7), but also at the time of the normal printing (Pass 8 and after it), as shown in FIG. 13. For example, in FIG. 13, the nozzle #6 on the most upstream side among the ejection-able nozzles of the white nozzle row W in Pass 1 at the time of the upper end printing and the nozzle #7 on the most upstream side among the ejection-able nozzles of the white nozzle row W in Pass 2 are shifted by three frames (1.5 nozzles). Similarly, the nozzle #12 on the most upstream side among the ejection-able nozzles of the white nozzle row W in Pass 8 at the time of the normal printing and the nozzle #12 on the most upstream side among the ejection-able nozzles of the white nozzle row W in Pass 9 are also shifted by three frames (1.5 nozzles).

As a result, it is possible to make the time after the printing of a background image and until the printing of a color image thereon be the same as those at the time of the upper end printing and the time of the normal printing. For example, as shown in the right drawing of FIG. 13, since at a raster line L1 on the most downstream side in the transport direction, after the printing of a background image by Pass 3, a color image is printed by Pass 5, a color image is printed with one pass skipped after the printing of a background image. Similarly, at the tenth raster line L10, after the printing of a background image by Pass 6, a color image is printed by Pass 8, and at the fourteenth raster line L14, after the printing of a background image by Pass 8, a color image is printed by Pass 10, whereby a color image is printed with one pass skipped after the printing of a background image. In this manner, by making the interval between the printing of a background image and the printing of a color image be constant at the time of the upper end printing and the time of the normal printing, density unevenness of an image can be prevented.

Also, not only at the time of the upper end printing, but also at the time of the normal printing, at one raster line, an interval where background images are formed by two kinds of nozzles and an interval where color images are formed by two kinds of nozzles can become constant. For example, at the raster line L1, background images are formed in Pass 1 and Pass 3 (an interval is one pass) and color images are formed in Pass 5 and Pass 7 (an interval is one pass). Similarly, at the raster line L10, background images are formed in Pass 4 and Pass 6 (an interval is one pass) and color images are formed in Pass 8 and Pass 10 (an interval is one pass). In this manner, by making the printing methods (dot formation methods) of the upper end printing and the normal printing be the same, density unevenness of an image can be prevented. In addition, at one raster line, an interval in which background images are formed by two kinds of nozzles, an interval between the printing of a background image and the printing of a color image, and an interval in which color images are formed by two kinds of nozzles are all constant (all of the intervals are one pass).

Further, in this embodiment, by making a shift amount of the ejection-able nozzle to the upstream side in the transport direction at the time of the upper end printing constant, the nozzles on the downstream side in the transport direction of the white nozzle row W can be averagely used. Also, by making a shift amount of the ejection-able nozzle to the upstream side in the transport direction at the time of the upper end printing constant, a transport amount of the medium S becomes constant. As a result, the transport operation can be stabilized, so that printing control can be easily performed.

Next, the printing of the lower end portion of the medium S will be explained by using FIG. 14. Here, the printing is set to be finished at Pass 20. An operation up to Pass 13 (the transport operation after it) is set to be the normal printing (the time of the normal image formation), and an operation for printing a color image by the nozzles (#1 to #6) of a half on the downstream side in the transport direction of the color nozzle row Co and printing a background image by the nozzles (#7 to #12) of a half on the upstream side in the transport direction of the white nozzle row W and an operation for transporting the medium S by 1.5d are alternately repeated. Then, an operation from Pass 14 to Pass 20 corresponds to the time of the image formation of the lower end portion of the medium.

In Pass 14, the nozzles (#1 to #6) of a half on the downstream side in the transport direction of the color nozzle row Co and the nozzles (#7 to #12) of a half on the upstream side in the transport direction of the white nozzle row W are set to be the ejection-able nozzles. However, as shown in FIG. 14, the position of the raster line which is formed by the nozzle #11 of the head 41 of Pass 14 becomes the print ending position (a thick line). Therefore, in Pass 14, from the nozzle #12 of the white nozzle row W, ink droplets are not ejected. Then, in Pass 14 and after it, the medium S is transported by an amount reduced to a length 0.5d (1 frame) of a half of the nozzle pitch d.

In subsequent Pass 15, the nozzles #2 to #7 of the color nozzle row Co and the nozzles #8 to #12 of the white nozzle row W are set to be the ejection-able nozzles. However, from the nozzles #11 and #12 of the white nozzle row W, ink droplets are not ejected. In this manner, in the lower end printing, at the white nozzle row W and the color nozzle row Co, the ejection-able nozzles are shifted one by one to the upstream side in the transport direction for every pass. However, among the ejection-able nozzles, from the nozzles which are located further on the upstream side in the transport direction than the print ending position (a thick line) in the drawing, ink droplets are not ejected.

In Pass 16, the nozzles #3 to #8 of the color nozzle row Co and the nozzles #9 to #12 of the white nozzle row W are set to be the ejection-able nozzles. However, from the nozzles #11 and #12 of the white nozzle row W, ink droplets are not ejected. In Pass 17, ink droplets are ejected from the nozzles #4 to #9 of the color nozzle row Co, in Pass 18, ink droplets are ejected from the nozzles #5 to #9 of the color nozzle row Co, in Pass 19, ink droplets are ejected from the nozzles #6 to #8 of the color nozzle row Co, and in Pass 20, ink droplets are ejected from the nozzles #7 and #8 of the color nozzle row Co.

As a result, it is possible to print a color image on a background image in the posterior pass. Also, as shown in the right drawing of FIG. 14, one raster line is formed by dots by two kinds of nozzles of the white nozzle row W and dots by two kinds of nozzles of the color nozzle row Co.

In this manner, at the time of the lower end printing, a color image is printed by using the nozzles different from the nozzles (#1 to #6) which print a color image at the time of the normal printing. Additionally speaking, the nozzles which print a color image at the time of the lower end printing are set to be nozzles which are located further on the upstream side in the transport direction than the nozzles which print a color image at the time of the normal printing.

As a result, in the comparative example (FIG. 12), the position of the raster line which is formed by the nozzle #2 of the head 41 of Pass 20 becomes the print ending position, whereas in this embodiment, as shown in FIG. 14, the position of the raster line which is formed by the nozzle #8 of the head 41 of Pass 20 becomes the print ending position (a thick line). That is, in this embodiment, it is possible to make the print ending position be further on the upstream side in the transport direction than that in the comparative example, so that the position control range of the medium S can be shortened, whereby a margin amount of the medium S can become smaller.

Also, in this embodiment, since the nozzles (#7 to #12) on the upstream side in the transport direction of the color nozzle row Co are also used for the printing, thickening of ink (an ejection defect) can be prevented. Also, in this embodiment, since not only the nozzles on the downstream side of the color nozzle row Co, but also the nozzles on the upstream side are used, so that many kinds of nozzles are used, a difference in characteristic between nozzles can be alleviated.

In addition, at the time of the lower end printing, the ejecting nozzles of the color nozzle row Co are shifted to the upstream side in the transport direction in accordance with the progress of the printing. Also, at the time of the lower end printing, in accordance with the transition of the ejection-able nozzles of the color nozzle row Co to the upstream side in the transport direction, the ejection-able nozzles of the white nozzle row W are reduced to the upstream side in the transport direction. By doing so, the transition from the normal printing to the lower end printing is possible, so that on the background image printed in the prior pass, a color image can be printed in the posterior pass.

Also, in order to make the dot formation methods at the time of the lower end printing and the time of the normal printing be the same, the total amount of a shift amount of the ejection-able nozzle of the color nozzle row Co to the upstream side in the transport direction at the time of the lower end printing and a transport amount of the medium S at the time of the lower end printing is made to be the same as a transport amount of the medium S at the time of the normal printing. At the time of the normal printing, a positional relationship between the ejection-able nozzles (#1 to #6) of the color nozzle row Co and the medium S is shifted by 1.5 nozzles (3 frames) to the transport direction for every pass. Therefore, at the time of the lower end printing, a transport amount of the medium S is set to be half a nozzle (1 frame), and the position of the ejection-able nozzle is shifted one nozzle (2 frames) to the upstream side in the transport direction for every pass. By doing so, it is possible to make the interval between the printing of a background image and the printing of a color image constant at the time of the normal printing and the time of the lower end printing, so that density unevenness of an image can be suppressed. Further, in this embodiment, since a shift amount of the ejection-able nozzle to the upstream side in the transport direction at the time of the lower end printing is constant, the nozzles on the upstream side in the transport direction of the color nozzle row Co can be averagely used. Also, by making a shift amount of the ejection-able nozzle to the upstream side in the transport direction at the time of the lower end printing constant, a transport amount of the medium S becomes constant. As a result, the transport operation can be stabilized, so that printing control can be easily performed.

Other Embodiments

In each embodiment described above, a printing system having an ink jet printer has been typically described. However, the disclosure of an upper end printing method or the like is included. Also, the above-described embodiments are for facilitating the understanding of the invention, but are not intended to construe the invention as being limited thereto. The invention can be modified or improved without departing from the purpose thereof, and it is also needless to say that the equivalents thereto are included in the invention. In particular, embodiments which are described below are also included in the invention.

Concerning Upper End Printing Process

In the above-described embodiments, also at the time of the printing of the upper end portion (the downstream side in the transport direction) of the medium, the nozzles for printing a background image are set to be different from those at the time of the normal printing (the nozzles on the downstream side in the transport direction of the white nozzle row W are used). However, the invention is not limited thereto. For example, at the time of the printing of the upper end portion of the medium, similarly to the time of the normal printing, a background image may also be printed by the nozzles (the fixed nozzles) on the upstream side in the transport direction of the white nozzle row W.

Concerning Printed Matter

In the above-described embodiments, a printed matter (so-called surface printing) in which a background image is printed by white ink and a color image is printed thereon by nozzle rows (YMCK) for color ink is taken as an example. However, the invention is not limited thereto. For example, a printed matter (so-called backing printing) may also be adopted in which a color image is printed on a medium such as a transparency film and a background image is printed thereon, whereby an image is seen from the opposite side to the printed surface of the medium. In this case, at the time of the normal printing, the nozzles which eject ink from the color nozzle row Co are set to be nozzles which are located further on the upstream side in the transport direction than the nozzles which eject ink from the white nozzle row W. Then, at the time of the lower end printing, by using the nozzles on the upstream side in the transport direction of the white nozzle row W, the print ending position is made to be on the upstream side in the transport direction as much as possible. Also, the invention is not limited to a background image by white ink, but a background image may also be printed by ink of another color (for example, YMCK or metallic color).

Also, a printed matter may also be adopted in which a background image is printed on a medium by white ink, a color image is printed thereon, and finally, coating is performed by clear ink. In this case, for example, at the time of the normal printing, the background image is printed by the nozzles of ⅓ on the upstream side in the transport direction of the white nozzle row W, the color image is printed by the nozzles of ⅓ of the central portion of the color nozzle row Co, and the coating is performed by the nozzles of ⅓ on the downstream side in the transport direction of a clear ink nozzle row. Then, at the time of the lower end printing, by using the nozzles on the upstream side in the transport direction of the clear ink nozzle row, the print ending position is made to be on the upstream side in the transport direction as much as possible.

Also, in the above-described embodiments, as shown in FIG. 3, four nozzles which respectively eject color ink (YMCK) are arranged in the moving direction. However, the invention is not limited thereto. For example, a configuration may also be adopted in which the nozzle rows of two colors among the nozzle rows of four colors are arranged in the transport direction and groups of the nozzle rows of two colors which are arranged in the transport direction are arranged in the moving direction. Then, the length of the white nozzle row W is set to be the length for the nozzle rows of two colors. In such a printer, when a color image is printed on a background image of white ink, for example, it is preferable if at the nozzle row on the upstream side among the nozzle rows of two colors which are arranged in the transport direction, the nozzles of a half on the downstream side in the transport direction are used, at the nozzle row on the downstream side, the nozzles of a half on the upstream side in the transport direction are used, and the white nozzle row W uses the nozzles of ¼ on the most upstream side in the transport direction. Also in this case, at the time of the lower end printing, by using the nozzles on the upstream side in the transport direction of the color nozzle row Co, the print ending position is made to be on the upstream side in the transport direction as much as possible.

Concerning Printing Method

In the above-described embodiments, the band printing and the overlap printing are taken as an example. However, the invention is not limited thereto. Other printing method (for example, a printing method in which as in interlace printing, a plurality of raster lines is formed between raster lines which are arranged at nozzle pitch intervals, in a different pass) may also be adopted. Also in the other printing method, it is preferable if without fixing the nozzles of the color nozzle row Co which print a color image, the nozzles on the upstream side in the transport direction of the color nozzle row Co are used at the time of the lower end printing.

Concerning Background Image and Color Image

In the above-described embodiments, a background image is printed only by white ink. However, the invention is not limited thereto. In order to change a hue of a background image, the background image may also be printed by mixing color ink (for example, cyan ink) to white ink. That is, ink may also be ejected from the nozzles in which positions in the transport direction are the same in the white nozzle row W and the color nozzle row Co, in the same pass. For example, in Pass 3 of FIG. 9, the nozzles for printing the background image are the nozzles #13 to #24 of the white nozzle row W and the nozzles #13 to #24 of the color nozzle row Co, and the nozzles for printing the color image are the nozzles #1 to #12 of the color nozzle row Co.

Conversely, in order to increase color reproducibility, a color image may also be printed by adding white ink to color ink (YMCK). In this case, for example, in Pass 3 of FIG. 9, the nozzles for printing the background image are the nozzles #13 to #24 of the white nozzle row W, and the nozzles for printing the color image are the nozzles #1 to #12 of the color nozzle row Co and the nozzles #1 to #12 of the white nozzle row W.

Concerning Fluid Ejecting Apparatus

In the above-described embodiments, as the fluid ejecting apparatus, the ink jet printer has been illustrated. However, the invention is not limited thereto. If it is a fluid ejecting apparatus, the invention is also applicable to various industrial apparatuses besides a printer. The invention is also applicable to, for example, a printing apparatus for applying a pattern on a cloth, a color filter manufacturing apparatus, an apparatus for manufacturing a display such as an organic EL display, a DNA chip manufacturing apparatus which manufactures a DNA chip by applying solution, in which DNA is melted, on a chip, or the like.

Also, a fluid ejecting method may also be a piezo method which ejects fluid by expanding or contracting an ink chamber by application of a voltage to a driving element (piezo element), or a thermal method which generates air bubbles in a nozzle by using a heater element and ejects liquid by the air bubbles.

Also, ink which is ejected from the head 41 may also be ultraviolet cure type ink which is cured by irradiation of ultraviolet rays. In this case, it is preferable if a head which ejects the ultraviolet cure type ink and an irradiator which irradiates the ultraviolet cure type ink with the ultraviolet rays are mounted on the carriage 31. Also, powder may also be ejected from a head.

What is claimed is:

1. A fluid ejecting apparatus comprising:

(1) a first nozzle row that includes first nozzles that eject first fluid;

(2) a second nozzle row that includes second nozzles that eject second fluid;

(3) a movement mechanism which moves the first nozzle row and the second nozzle row with respect to a medium in a moving direction;

(4) a transport mechanism which transports the medium with respect to the first nozzle row and the second nozzle row in a transport direction intersecting the moving direction; and (5) a control section which causes execution of a forming operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the transport direction by the transport mechanism, wherein in a case where after the formation of a first image by the first fluid in a certain forming operation, a second image is formed on the first image by the second fluid in another forming operation, at the time of a first forming operation that ejects the first and the second fluid to a first region of the medium, the second nozzles of the second nozzle row used for forming the second image are set to be nozzles which are located further on a downstream side in the transport direction than the first nozzles of the first nozzle row used for forming the first image, and at the time of a second forming operation that ejects the second fluid to a second region of the medium located upstream of the first region in a transport direction, the second nozzles of the second nozzle row used for forming the second image are set to be nozzles which are located further on the upstream side in the transport direction than the second nozzles for forming the second image at the time of the first forming operation.

2. The fluid ejecting apparatus according to claim 1, wherein at the time of the second forming operation, with respect to the second nozzles of the second nozzle row used for forming the second image at the time of a certain forming operation, the second nozzles of the second nozzle row used for forming the second image at the time of the subsequent forming operation are shifted to the upstream side in the transport direction, and an amount at which the medium is transported in the transport direction by the transport operation at the time of the second forming operation is the same as an amount at which the medium is transported in the transport direction by the transport operation at the time of the first forming operation.

3. The fluid ejecting apparatus according to claim 2, wherein at the time of the second forming operation, with respect to the second nozzles of the second nozzle row used for forming the second image at the time of a certain forming operation, the second nozzles of the second nozzle row used for forming the second image at the time of the subsequent forming operation are shifted to the upstream side in the transport direction a constant amount.

4. The fluid ejecting apparatus according to claim 1, wherein the time after the formation of the first image at a certain region on the medium at the time of the first forming operation and until the formation of the second image is the same as the time after the formation of the first image at a certain region on the medium at the time of the second forming operation and until the formation of the second image.

5. The fluid ejecting apparatus according to claim 1, wherein at the time of a third forming operation that elects the first fluid to a third region of the medium located downstream of the first region in the transport direction, the control section sets the first nozzles of the first nozzle row used for forming the first image to be nozzles which are located further on the downstream side in the transport direction than the first nozzles of the first nozzle row used for forming the first image at the time of the first forming operation.

6. A fluid ejecting method in which by a fluid ejecting apparatus a forming operation for ejecting fluid from first nozzles in a first nozzle row and second nozzles in a second nozzle row while moving the first nozzle row and the second nozzle row in a moving direction and a transport operation for transporting a medium with respect to the first nozzle row and the second nozzle row in a transport direction intersecting the moving direction are performed, after the formation of a first image by the first fluid in a certain forming operation, a second image is formed on the first image by the second fluid in another forming operation, the method comprising:

ejecting fluid by setting the second nozzles of the second nozzle row used for forming the second image to be nozzles which are located further on a downstream side in the transport direction than the first nozzles of the first nozzle row used for forming the first image, at the time of first forming operation that ejects the first and second fluid to a first region of the medium; and ejecting fluid by setting the second nozzles of the second nozzle row used for forming the second image to be nozzles which are located further on an upstream side in the transport direction than the second nozzles of the second nozzle row used for forming the second image at the time of the first forming operation, at the time of a second forming operation that ejects the second fluid to a second region of the medium located upstream of the first region in the transport direction.

* * * * *